US010930419B2

(12) United States Patent
Zushi et al.

(10) Patent No.: US 10,930,419 B2
(45) Date of Patent: Feb. 23, 2021

(54) INDUCTOR

(71) Applicant: Nissan Motor Co., Ltd., Yokohama (JP)

(72) Inventors: Yusuke Zushi, Kanagawa (JP); Tetsuya Hayashi, Kanagawa (JP); Yasuaki Hayami, Kanagawa (JP); Wei Ni, Kanagawa (JP); Akimitsu Yamamoto, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 16/309,544

(22) PCT Filed: Jun. 21, 2016

(86) PCT No.: PCT/JP2016/068372

§ 371 (c)(1),
(2) Date: Dec. 13, 2018

(87) PCT Pub. No.: WO2017/221321

PCT Pub. Date: Dec. 28, 2017

(65) Prior Publication Data

US 2019/0341178 A1 Nov. 7, 2019

(51) Int. Cl.

| | |
|---|---|
| ***H01F 27/28*** | (2006.01) |
| ***H01F 5/06*** | (2006.01) |
| ***H01F 17/04*** | (2006.01) |
| ***H01F 27/24*** | (2006.01) |
| ***H01F 27/29*** | (2006.01) |

(Continued)

(52) U.S. Cl.

CPC ..... *H01F 5/06* (2013.01); *H01F 17/04* (2013.01); *H01F 27/24* (2013.01); *H01F 27/292* (2013.01); *H01F 27/324* (2013.01); *H01F 41/06* (2013.01)

(58) Field of Classification Search

USPC ..... 336/222, 221, 225

See application file for complete search history.

(56) References Cited

U.S. PATENT DOCUMENTS 2,963,669 A * 12/1960 Salisbury ..... H01F 17/02 336/192
5,032,816 A * 7/1991 Lenzing ..... H01F 27/2823 336/141
2008/0231402 A1 9/2008 Jow et al.

(Continued)

FOREIGN PATENT DOCUMENTS

CN 104603889 A 5/2015
EP 1 460 654 A1 9/2004

(Continued)

*Primary Examiner* — Shawki S Ismail
*Assistant Examiner* — Kazi S Hossain
(74) *Attorney, Agent, or Firm* — Global IP Counselors, LLP

(57) ABSTRACT

An inductor includes a substrate as a base material, a core portion, a coil portion, an insulating portion formed between conductors of the coil portion, and a terminal portion connecting the core portion and the coil portion to the outside. A main direction of a magnetic field that is generated in accordance with current flowing through the coil portion extends in a planar direction of the substrate. In at least a portion of the coil portion, both width and thickness of a rectangular cross-sectional area of the coil portion are larger than the width of the insulating portion.

13 Claims, 11 Drawing Sheets

(51) Int. Cl.
*H01F 27/32* (2006.01)
*H01F 41/06* (2016.01)

(56) References Cited

U.S. PATENT DOCUMENTS

| | | | | |
|---|---|---|---|---|
| 2012/0249282 | A1* | 10/2012 | Sin | H01L 28/10 336/200 |
| 2013/0207764 | A1* | 8/2013 | Yeh | H01F 27/292 336/65 |
| 2016/0163444 | A1 | 6/2016 | Choi et al. | |
| 2017/0194084 | A1* | 7/2017 | Choi | H01F 41/16 |

FOREIGN PATENT DOCUMENTS

| | | | |
|---|---|---|---|
| JP | H04-363006 | A | 12/1992 |
| JP | 3441082 | B2 | 8/2003 |
| JP | 2003-297632 | A | 10/2003 |
| JP | 2006-294997 | A | 10/2006 |
| JP | 4482477 | B2 | 6/2010 |

* cited by examiner

INDUCTOR

CROSS-REFERENCE TO RELATED APPLICATIONS

This application is a U.S. national stage application of International Application No. PCT/JP2016/068372, filed on Jun. 21, 2016.

BACKGROUND

Technical Field

The present invention relates to an inductor using a substrate as a base material.

Background Art

An inductor that is formed using a thin-film formation technique is known from the prior art. The inductor is formed by arranging, on a support that serves as the base material, a magnetic layer, a plurality of coils wound around the magnetic layer, etc. A process to form the coil is separated into two stages in order to narrow the gaps between the conductors of the coil. Coils manufactured with this process have a wide rectangular cross-sectional area. Due to the wide rectangular cross-sectional area of such coils, the coil density of the inductor increases (for example, see Japanese Laid-Open Patent Application No. 2003-297632).

SUMMARY

For example, in order to improve the current capacity of the inductor, it is necessary to decrease the resistance value of the coil. It is thus effective to make the rectangular cross-sectional area of the coil wide. In order to obtain a high inductance value, on the other hand, it is important to have not only a large number of coil turns and a high turn density, but also a large rectangular cross-sectional area of the coil in the thickness direction for linkage of the magnetic flux generated by the coil. In an inductor that generates a magnetic field in the planar direction of a substrate, in which the substrate is used as the base material, it is preferable that the substrate be of sufficient thickness in order to gain rectangular cross-sectional area in the thickness direction. However, the thickness of the rectangular cross-sectional area of the coil of the conventional inductor is smaller than the gaps between the coil conductors. Due to this small thickness, it is not possible to increase the rectangular cross-sectional area of the coil portion in the thickness direction. On the other hand, even if the thickness of the coil portion is simply increased, there remains the problem of decreasing inductance due to magnetic flux leakage from the gaps between the conductors. In addition, if the thickness of the coil is increased excessively, the rectangular cross-sectional area also becomes large, and the current capacity decreases. Consequently, there is the problem that it is not possible to improve both the inductance and the current density at the same time. Here, the "gap" is the distance between adjacent conductors. "Coil density" is the ratio of the cross-sectional area of the conductors to the cross-sectional area of the coil. "Current capacity" refers to a current per unit area, which can be represented, for example, by the value obtained by dividing the current by the cross-sectional area of the coil. "Magnetic flux" refers to the number of magnetic field lines that pass through one turn of the coil. "Linkage" means that the relationship between the magnetic flux and the coil is similar to that of the linkage of the links of a chain. If the coil has N (an integer of 1 or more) turns, the "magnetic flux linkage" refers to the number of magnetic field lines that pass through the entire coil having N turns. "Current density" refers to the flow of electricity (charge) in a direction perpendicular to a unit area per unit time.

In view of the problem described above, an object of the present invention is to provide an inductor that can achieve both improved inductance and improved current density.

In order to achieve the object described above, the present invention is an inductor, which employs a substrate as base material and which comprises a core portion, a coil portion, insulating portions formed between the conductors of the coil portion, and terminal portions that connect the core portion and the coil portion to the outside. A main direction of a magnetic field that is generated in accordance with a current that flows in the coil portion is a planar direction of the substrate. In at least a portion of the coil portion, both width and thickness of a rectangular cross-sectional area of the coil portion are set larger than the width of the insulating portion.

As a result, it is possible to provide an inductor in which both improved inductance and improved current density can be achieved.

DETAILED DESCRIPTION OF THE EMBODIMENTS

Figure 1:
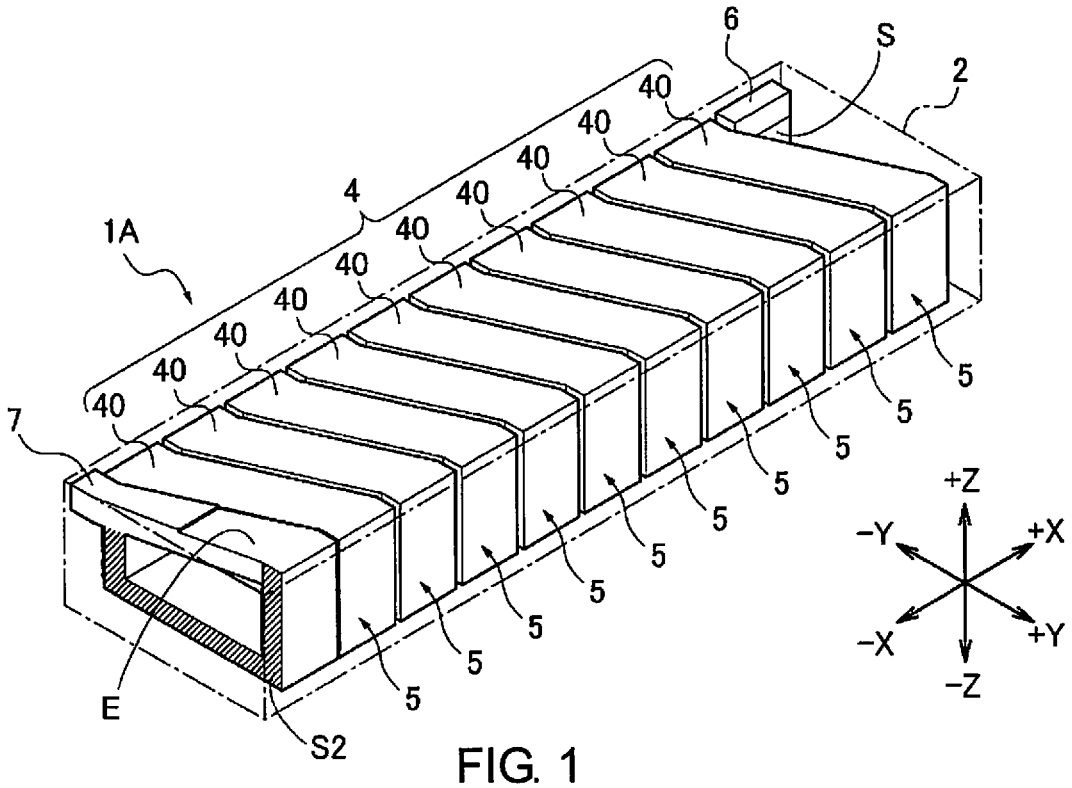
FIG. 1 is a perspective view illustrating an overall configuration of a power inductor in a first embodiment.

Preferred embodiments for realizing an inductor according to the present invention will be described below with reference to Embodiments 1 to 5 illustrated in the drawings.

First Embodiment

The configuration is described first. The inductor according to the first embodiment is applied to a power inductor (one example of the inductor) that is connected to an inverter of a motor/generator serving as a travel drive source of a vehicle. An "overall configuration" and a "dimensional configuration" will be separately described below regarding the configuration of the power inductor according to the first embodiment.

FIG. 1 illustrates the overall configuration of the power inductor according to the first embodiment. The overall configuration will be described below with reference to FIG. 1.

For the sake of convenience of the explanation, the positional relationship between each member will be described below with reference to an XYZ orthogonal coordinate system. Specifically, the width direction (+X direction) of the power inductor is defined as the X-axis direction. The front-rear direction (+Y direction) of the power inductor, which is orthogonal to the X-axis direction, is defined as the Y-axis direction, and the height direction (+Z direction) of the power inductor, which is orthogonal to the X-axis direction and the Y-axis direction, is defined as the Z-axis direction. Where appropriate, the +X direction is referred to as rightward (−X direction is referred to as leftward), the +Y direction is referred to as forward (−Y direction is referred to as rearward), and the +Z direction is referred to as upward (−Z direction is referred to as downward).

A power inductor 1A of the first embodiment is obtained by forming a coil portion that serves as a basic component inside of a base material. The power inductor 1A is an inductor that uses a substrate 2 of silicon (base material). The power inductor 1A comprises a core portion 3, a coil portion 4 (for example, copper), coil portion inter-turn gaps 5 (insulating portions), an electrode part 6 (terminal portion), and an electrode part 7 (terminal portion).

The substrate 2 serves as a support that supports the core portion 3, the coil portion 4, the electrode part 6, and the electrode part 7. The substrate 2 has an elongated shape that extends in the Y-axis direction.

The core portion 3 is embedded in an interior 2*i* of the substrate 2 and serves as a magnetic path for obtaining a desired inductance. Here, "magnetic path" is a path for the magnetic flux that is generated in accordance with the current that flows in the coil portion 4.

The coil portion 4 generates a magnetic field in accordance with the applied current. A main direction of the magnetic field that is generated in accordance with the current that flows in the coil portion 4 extends in the X-axis direction (planar direction) of the substrate 2. In the coil portion 4, a plurality of conductors 40 are formed in a spiral shape on an outer periphery of the core portion 3. The conductors 40 are disposed in positions that are separated from each other in the Y-axis direction at intervals corresponding to the coil portion inter-turn gap 5. The separation distance in the Y-axis direction (width d of the coil portion inter-turn gap 5, described further below) is set in advance with consideration given to leakage magnetic flux). The coil portion 4 is covered with a silicon oxide film, which is not shown. The coil portion 4 has a winding start portion S at an end portion in the +X direction. The coil portion 4 has a winding finish portion E at the end portion in the −X direction. Here, "magnetic field" refers to a state of a space in which magnetism acts. "Magnetism" refers to a physical property unique to a magnet, which attracts iron filings or indicates a bearing. "Planar direction" means the XY-axis direction. "Leakage magnetic flux" means the magnetic flux that leaks to the outside of the power inductor 1A from the interior 2*i* of the substrate 2 via the coil portion inter-turn gaps 5.

The coil portion inter-turn gaps 5 are formed between the conductors 40 of the coil portion 4. The coil portion inter-turn gaps 5 electrically insulate the adjacent conductors 40 from each other. The coil portion inter-turn gaps 5 are covered with the silicon oxide film, which is not shown. Diagonal element portions 5*n* are portions in which adjacent conductors 40 are connected to each other, offset in the X-axis direction.

The electrode part 6 (for example, copper) and the electrode part 7 (for example, copper) connect the core portion 3 and the coil portion 4 to the outside. The electrode part 6 connects the coil portion 3 and the coil portion 4 to a battery, which is not shown, via the winding start portion S of the coil portion 4. The electrode part 7 connects the coil portion 3 and the coil portion 4 to an inverter, which is not shown, via the winding finish portion E of the coil portion 4.

Figure 2:
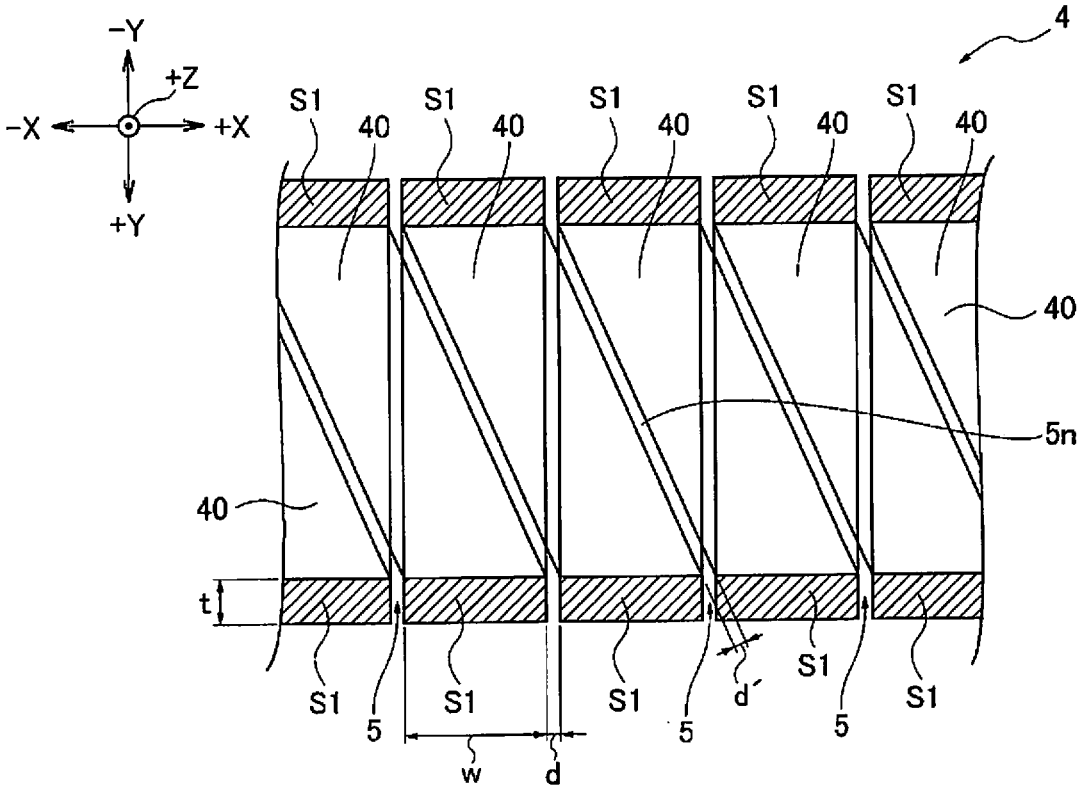
FIG. 2 is a cross-sectional view illustrating a dimensional configuration of the power inductor according to the first embodiment.

FIG. 2 is a cross-sectional view illustrating the dimensional configuration of the power inductor according to the first embodiment. The dimensional configuration will be described below with reference to FIG. 2.

In the coil portion 4, the rectangular cross-sectional areas S1 have widths w. In the coil portion 4, the rectangular cross-sectional areas S1 have thicknesses t. The widths w of the rectangular cross-sectional areas S1 are set larger than the thicknesses t of the rectangular cross-sectional areas S1 (w>t).

The coil portion inter-turn gap 5 is the width d in the Z-axis direction. In the coil portion inter-turn gaps 5, the diagonal element portions 5*n* have a width d' (d>d'). In all regions of the coil portion 4, both the width w and the thickness t of the rectangular cross-sectional areas S1 of the coil portion 4 are set larger than the width d of the coil portion inter-turn gaps 5. That is, an upper limit value for the width w is set to a value with which it is possible to suppress the resistance value of the coil portion 4 to a desired value or lower. A lower limit value of the width w is set to a value that is greater than the width d of the coil portion inter-turn gaps 5. The upper limit value of the thickness t is set to a value with which it is possible to suppress the amount of leakage magnetic flux to the desired value or lower. The lower limit value of the thickness t is set to a value that is greater than the width d of the coil portion inter-turn gaps 5. The width w of the coil portion inter-turn gaps 5 is set to about 1 μm or less. The width d and the thickness t of the rectangular cross-sectional areas S1 are set larger than the width d of the coil portion inter-turn gaps 5. The width w is set to 20 μm to several mm (however, less than or equal to 10 mm). The thickness t is set to about several μm to 200 μm. Here, "offset" means the gap between the conductors 40 when spirally winding the conductor 40 in a direction along an axis of the coil portion 4.

The actions are described next. "Generation mechanism of magnetic saturation" and "characteristic action of the power inductor 1A" will be described separately regarding the actions of the power inductor 1A according to the first embodiment.

Since a larger current flows in the power inductor compared to a common printed coil portion for communication, for example, the generated magnetic field is also larger. When using a magnetic core, there is a problem that it easily reaches the saturation magnetic flux density of the core due to the occurrence of magnetic saturation. The generation mechanism of magnetic saturation will be described below. Here, "magnetic saturation" refers to a state in which a magnetic field is externally applied to a magnetic body and the magnetization intensity no longer changes even if a greater magnetic field is externally applied. "Saturation magnetic flux density" is the magnetic flux density in the state in which magnetic saturation has occurred. "Magnetic flux density" is the areal density of the magnetic flux per unit area.

The power inductor is used in an electric power converter, often for the purpose of storing energy or maintaining electric current, and is characterized in that the amount of current that flows therein is larger compared to a circuit for communication. That is, it is important for the power inductor to have a large current capacity while being able to function as an inductor. In general, a power inductor is formed by winding a conductive wire coated with insulating film around a magnetic core. When a semiconductor device used in the electric power converter responds at high speed, the switching frequency of the electric power converter becomes high, and the fundamental frequency of the current that flows in the inductor also becomes high. Consequently, a problem occurs in which the current density distribution in the conductive wire due to the skin effect becomes pronounced, and the resistance loss of the coil portion increases. To solve this problem, a method for suppressing the current density distribution by using litz wire, formed by bundling ultra-fine conductive wires coated with insulating film, is adopted. Here, the "skin effect" refers to the phenomenon in which, when an alternating current flows through a conductor, the current density is high at the surface of the conductor and low away from the surface.

However, since the proportion of an insulator in the coil portion increases together with a rise in the fundamental frequency, there is the problem that the current density per unit volume of the inductor decreases. Particularly, in the case of a winding wire, since a change in shape is also large when the wire is wound around the core, it is difficult to maintain the reliability of an organic insulating film. Accordingly, it is preferable to apply a coating film that is sufficiently thicker than the thickness that is required according to the material properties.

On the other hand, in the printed coil portion that is used for communication, rather than winding the conductive wire, the coil portion is formed using photolithography, which does not entail changes in shape at the time of production. Thus, it is not necessary to provide redundant film thickness with respect to a required withstand voltage. In particular, silicon oxide films are highly reliable because such films are easily applied uniformly.

In view of the foregoing, in the power inductor as well, the proportion of the insulator relative to the conductor in the coil portion is reduced by forming the coil portion according to the same process for forming the printed coil portion, rather than winding the conductive wire, if the frequency is increased. As a result of this reduction, it is possible to increase the power density. However, because greater current flows in the power inductor compared to the printed coil portion for communication, the power inductor preferably has a structure that has lower resistance and high heat dissipation performance (cooling performance). In addition, in the power inductor, the strength of the generated magnetic field becomes greater as the current value increases. Thus, when a magnetic core is used, there is the problem that the saturation magnetic flux density of the core will be easily reached due to the occurrence of magnetic saturation.

Next, the inductance will be described based on the theoretical equation for a solenoid coil portion. The inductance L can be expressed by the following equation (1).

$$L = N\mu S\frac{N}{l} \tag{1}$$

Here, "N" is the number of turns of the coil portion that are connected in series. "μ" is a permeability of the magnetic path. "S" is the cross-sectional area with which the coil portion surrounds the core. "N/1" is the number of turns per unit length, i.e., the turn density. In addition, the magnetic flux density B, which is used in the process of deriving this equation (1), can be expressed by the following equation (2).

$$B = \mu H = \mu \frac{N}{l} \cdot I \quad (2)$$

Here, "I is the electric current that is applied to the coil portion. "H" is the magnetic field that is generated in the solenoid coil portion due to I. In general, when a magnetic body is used, the saturation magnetic flux density corresponding to the material is present, and there is a point at which the magnetic flux density does not increase even if the electric current is increased.

As can be seen from the above-described equation (2), since a large I flows in the power inductor, the same N/l as used in the prior art will quickly result in magnetic saturation. In order to increase the inductance without increasing the magnetic flux density, it is effective to adjust the permeability of the magnetic path and the turn density to be less than or equal to the saturation magnetic flux density, even when the required electric current is applied. That is, it is effective to increase the number of turns and the area with which the coil portion surrounds the core.

In the first embodiment, in at least a portion of the coil portion 4, both the width w and the thickness t of the rectangular cross-sectional areas S1 of the coil portion 4 are set larger than the width d of the coil portion inter-turn gaps 5. That is, the width d of the coil portion inter-turn gaps 5 is set smaller than both the width w and the thickness t of the rectangular cross-sectional areas S1. Thus, it is possible to reduce the magnetic flux leakage space. As a result, it is possible to improve the inductance without increasing the magnetic flux density. In addition, since the rectangular cross-sectional areas S1 of the coil portion 4 are structured to be wide in the X-axis direction, it is possible to effectively reduce the resistance value of the coil portion 4. Thus, it is possible to improve the current capacity of the power inductor 1A. As a result, it is possible to achieve an improvement in both inductance and current density.

In the first embodiment, in all regions of the coil portion 4, both the width w and the thickness t of the rectangular cross-sectional areas S1 of the coil portion 4 are set larger than the width d of the coil portion inter-turn gaps 5. That is, in all regions of the coil portion 4, it is possible to reduce the magnetic flux leakage space and to structure the rectangular cross-sectional areas S1 of the coil portion 4 to be wide in the X-axis direction. As a result, the region in which the inductance and the current density can be improved extends to all regions of the coil portion 4. Thus, it is possible to achieve an improvement in both inductance and current density over a wider range of the coil portion 4.

In the first embodiment, the width w of the rectangular cross-sectional areas S1 of the coil portion 4 is set larger than the thickness t of the rectangular cross-sectional areas S1 of the coil portion 4. That is, the rectangular cross-sectional areas S1 of the coil portion 4 have a shape that is long in the X-axis direction and short in the Y-axis direction. Thus, it is possible to ensure that the rectangular cross-sectional area S1 is wide while securing a wide cross-sectional area of the magnetic flux linkage that is generated by the coil portion 4 (cross-sectional area S2 in the Y direction shown in FIG. 1).

In the first embodiment, the base material is silicon. That is, the base material is made from silicon, which is a common semiconductor material. Thus, it is possible to manufacture the power inductor 1A using an existing semiconductor manufacturing device. Thus, the power inductor 1A can be manufactured at low cost.

The effects are described next. The effects listed below can be obtained according to the power inductor 1A of the first embodiment.

(1) An inductor (power inductor 1A) using a substrate (substrate 2) as a base material (silicon), comprises: a core portion (core portion 3); a coil portion (coil portion 4); an insulating portion (coil portion inter-turn gaps 5) formed between conductors (conductors 40) of the coil portion (coil portion 4); and a terminal portion (electrode part 6 and electrode part 7) that connect the core portion (coil portion 3) and the coil portion (coil portion 4) to the outside; wherein a main direction (X-axis direction) of a magnetic field that is generated in accordance with a current that flows in the coil portion (coil portion 4) extends in a planar direction (X-axis direction) of the substrate (substrate 2), and in at least a portion of the coil portion (coil portion 4), both a width (width w) and a thickness (thickness t) of rectangular cross-sectional area (rectangular cross-sectional area S1) of the coil portion (coil portion 4) are set larger than the width (width d) of the insulating portion (coil portion inter-turn gaps 5) (FIG. 2). As a result, it is possible to provide a semiconductor device (power inductor 1A) that can achieve an improvement in both the inductance and the current density.

(2) In all regions of the coil portion (coil portion 4), both the width (width w) and the thickness (thickness t) of the rectangular cross-sectional areas (rectangular cross-sectional area S1) of the coil portion (coil portion 4) are set larger than the width (width d) of the insulating portion (coil portion inter-turn gaps 5) (FIG. 2). Thus, in addition to the effect of (1), it is possible to achieve an improvement in both the inductance and the current density over a wider range of the coil portion (coil portion 4).

(3) The width (width w) of the rectangular cross-sectional area (cross-sectional areas S1) of the coil portion (coil portion 4) is set larger than the thickness (thickness t) of the rectangular cross-sectional area (rectangular cross-sectional areas S1) of the coil portion (coil portion 4) (FIG. 2). Thus, in addition to the effects of (1) and (2), it is possible to ensure that the rectangular cross-sectional area (rectangular cross-sectional area S1) is wide while securing a wide cross-sectional area (cross-sectional area S2 in the Y direction) of the magnetic flux linkage that is generated by the coil portion (coil portion 4).

(4) The base material is silicon (FIGS. 1 and 2). Thus, in addition to the effects of (1) to (3), the power inductor 1A can be manufactured at low cost.

Second Embodiment

The second embodiment is an example in which a plurality of coil portions are provided.

The configuration is described first. The inductor according to the second embodiment is applied to the power inductor (one example of the inductor) that is connected to the inverter of a motor/generator, in the same manner as in the first embodiment. The "overall configuration" and the "dimensional configuration" will be described separately below regarding the configuration of the power inductor according to the second embodiment.

Figure 3:
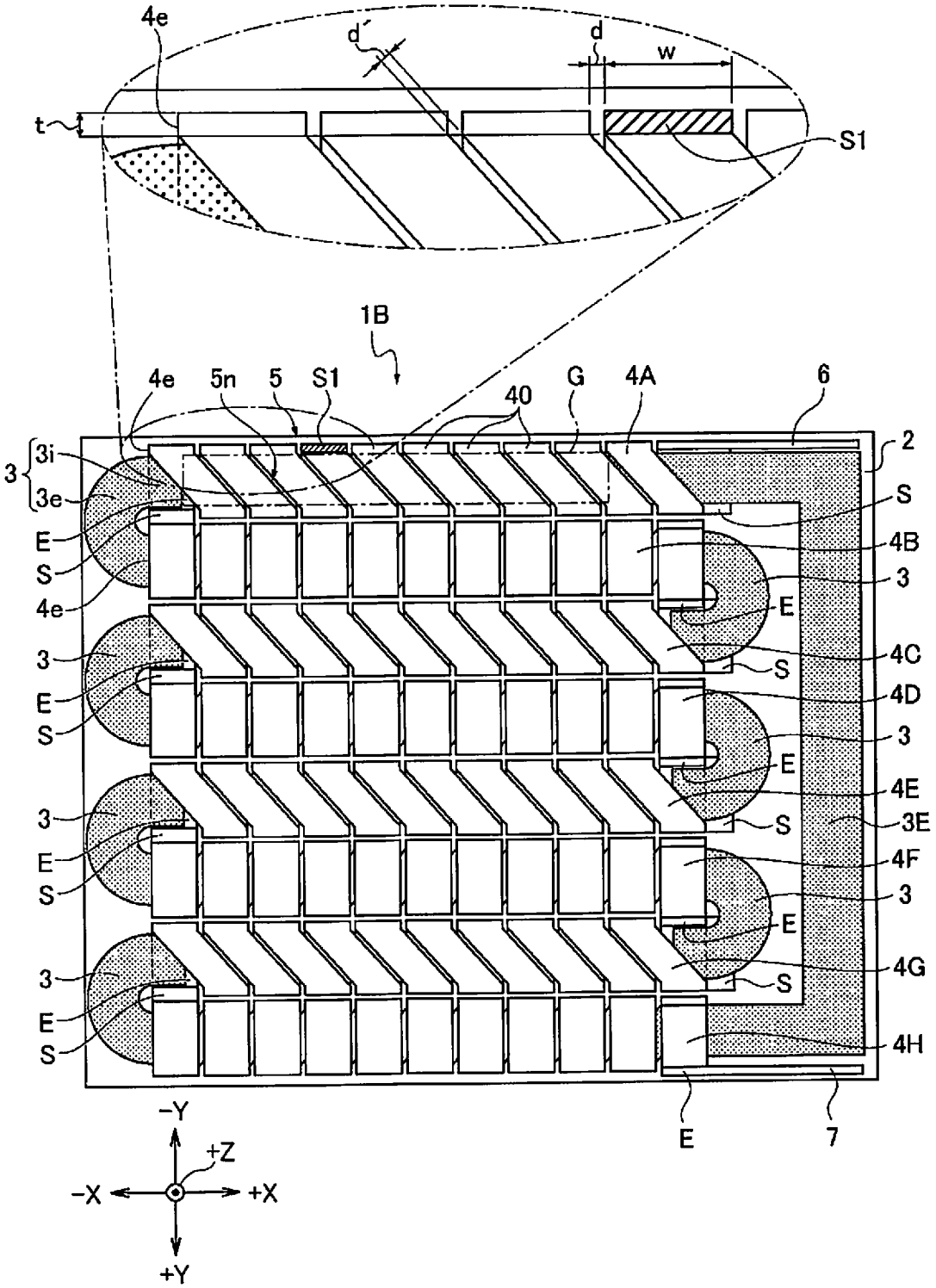
FIG. 3 is a plan view illustrating the overall configuration of the power inductor according to a second embodiment.

FIG. 3 illustrates the overall configuration of the power inductor according to the second embodiment. The overall configuration will be described below with reference to FIG. 3.

A power inductor 1B of the second embodiment is obtained by forming the coil portion that serves as the basic component inside the base material, in the same manner as in the first embodiment. The power inductor 1B is the inductor that uses the substrate 2 in silicon (base material), in the same manner as in the first embodiment. The power inductor 1B comprises a plurality of ferrite cores 3 (core portions), a plurality of the coil portions 4A-4H (for example, copper), the coil portion inter-turn gaps 5 (insulating portions), the electrode part 6 (terminal portion), and the electrode part 7 (terminal portion). The winding start portions S in FIG. 3 indicate the winding start portion S of each of the coil portions 4A-4H. The winding finish portions E indicate the winding finish portion E of each of the coil portions 4A-4H.

The substrate 2 serves as the support that supports each of the ferrite cores 3, each of the coil portions 4A-4H, the electrode part 6, and the electrode part 7. The substrate 2 has a rectangular outer shape.

Each of the ferrite cores 3 follows a meandering path and interlinks the magnetic flux that is generated in each of the coil portions 4A-4H. Each ferrite core 3 is disposed between the coil portions 4A-4H and serves as the magnetic path that interconnects the coil portions 4A-4H. Each ferrite core 3 has an enclosed portion 3*i* that is enclosed in the coil portions 4A-4H, and an exposed portion 3*e* that is exposed from the coil portions 4A-4H. The chain double-dashed line in the figure indicates the interface between the enclosed portion 3*i* and the exposed portion 3*e*. The ferrite core 3 that connects the winding finish portion E of the coil portion 4H and the winding start portion S of the coil portion 4A is defined as a terminal ferrite core 3E.

Each of the coil portions 4A-4H generates magnetic flux in accordance with the applied current. The coil portions 4A-4H are formed side by side in the Y-axis direction on the plane of the substrate 2. The coil portions 4A-4H are connected in series. The inputting of electric current to and the outputting of electric current from the coil portions 4A-4H occurs with respect to electrode 6 and electrode 7, respectively. That is, the electric current that is input from the electrode 6 via the winding start portion S of the coil portion 4A flows through the coil portions 4A-4H and is output to the outside from the electrode 7 via the winding finish portion E of the coil portion 4H. In addition, the main directions of the magnetic fields that are generated in accordance with the electric current are different between the coil portions 4B, 4D, 4F, and 4H and the coil portions 4A, 4C, 4E, and 4G. That is, the main direction of the magnetic fields that are generated in the coil portions 4B, 4D, 4F, and 4H is the +X direction. The main direction of the magnetic fields that are generated in the coil portions 4A, 4C, 4E, and 4G is the −X direction. A gap G surrounded by the single-dotted chain line shown in FIG. 3 is formed inside each of the coil portions 4A-4H, excluding an end portion 4*e* that encloses a portion of the enclosed portion 3*i*. The end portions 4*e* of the coil portion 4A and the coil portion 4H are coupled to each other by the terminal ferrite core 3E. Here, "gap G" means an area that is filled with a member having a lower permeability than the ferrite core 3 (for example, non-magnetic material such as air). "Non-magnetic material" refers to a substance that is not a ferromagnetic material. "Ferromagnetic material" refers to a substance that is easily magnetized by an external magnetic field, such as iron, cobalt, nickel, an alloy thereof, and ferrite, and to a substance that has relatively high permeability.

The coil portion inter-turn gaps 5 are formed between the conductors 40 of the coil portions 4A-4H. The coil portion inter-turn gaps 5 electrically insulate the adjacent conductors 40 from each other. The coil portion inter-turn gaps 5 are covered with the silicon oxide film, which is not shown. The diagonal element portions 5*n* are portions in which the conductors 40 of each of the coil portions 4A-4H are connected to each other, offset in the X-axis direction.

The electrode part 6 (for example, copper) and the electrode part 7 (for example, copper) connect the ferrite cores 3 and the coil portions 4A-4H to the outside. The electrode part 6 connects the ferrite cores 3 and the coil portions 4A-4H to the battery, which is not shown, via the winding start portion S of the coil portion 4A. The electrode part 7 connects the ferrite cores 3 and the coil portions 4A-4H to the inverter, which is not shown, via the winding finish portion E of the coil portion 4H.

The dimensional configuration will be described below with reference to FIG. 3.

In the coil portions 4A-4H, the width of the rectangular cross-sectional areas S1 is w, in the same manner as in the first embodiment. In the coil portions 4A-4H, the thickness of the rectangular cross-sectional areas S1 is t, in the same manner as in the first embodiment. The width w of the rectangular cross-sectional areas S1 is set larger than the thickness t of the rectangular cross-sectional areas S1, in the same manner as in the first embodiment.

The coil portion inter-turn gap 5 is the width d in the Z-axis direction, in the same manner as in the first embodiment. In the coil portion inter-turn gaps 5, the diagonal element portions 5*n* of the coil portions 4A, 4C, 4E, and 4G, have the width d' (d>d'), in the same manner as in the first embodiment. Although obscured and not visible in FIG. 3, the diagonal element portions 5*n* of the coil portions 4B, 4D, 4F, and 4H also have the width d' (d>d'). In all regions of the coil portions 4A-4H, both the width w and the thickness t of the rectangular cross-sectional areas S1 of the coil portions 4A-4H are set larger than the width d of the coil portion inter-turn gaps 5, in the same manner as in the first embodiment. That is, the upper limit value of the width w is set to a value with which it is possible to suppress the resistance value of each of the coil portions 4A-4H to the desired value or lower. The lower limit value of the width w is set to a value that is greater than the width d of the coil portion inter-turn gaps 5. The upper limit value of the thickness t is set to a value with which it is possible to suppress the amount of leakage magnetic flux to the desired value or lower. The lower limit value of the thickness t is set to a value that is greater than the width d of the coil portion inter-turn gaps 5.

The actions are described next. "Action of adjusting the permeability of the entire magnetic path," "action of decreasing the slope of the B-H curve," and "characteristic action of the power inductor 1B" will be described separately regarding the actions of the power inductor 1B according to the second embodiment.

The end portions 4*e* of the coil portion 4A and the coil portion 4H are coupled to each other by the terminal ferrite core 3E in a state in which there is no leakage magnetic flux. The magnetic fluxes that are generated in accordance with the applied current in the coil portions 4A-4H form a closed loop due to this coupling. Here, "loop" refers to a series of the flow of the magnetic fluxes that are formed by the ferrite cores 3 and the coil portions 4A-4H. "Closed loop" refers to a state in which the series of the flow of the magnetic fluxes is closed and not opened.

As described above, the inside of each of the coil portions 4A-4H, excluding the end portion 4*e* that encloses a portion of the enclosed portion 3*i*, is filled with the member having a lower permeability than the ferrite core 3. That is, the inside of each of the coil portions 4A-4H has a structure in which the permeability is lower in the innermost portion than at the end portion 4*e*. In this manner, in the coil portions 4A-4H, the permeability of the innermost portions, from which the magnetic flux is structurally less likely to leak, is adjusted to be low. With this adjustment, it becomes possible to decrease the equivalent permeability of the entire magnetic path, when the ferrite cores 3 and the coil portions 4A-4H are regarded as a single magnetic path. The decrease in the equivalent permeability can be realized by decreasing the slope of the B-H curve. It is thereby possible to avoid magnetic saturation of the entire magnetic path.

Figure 4:
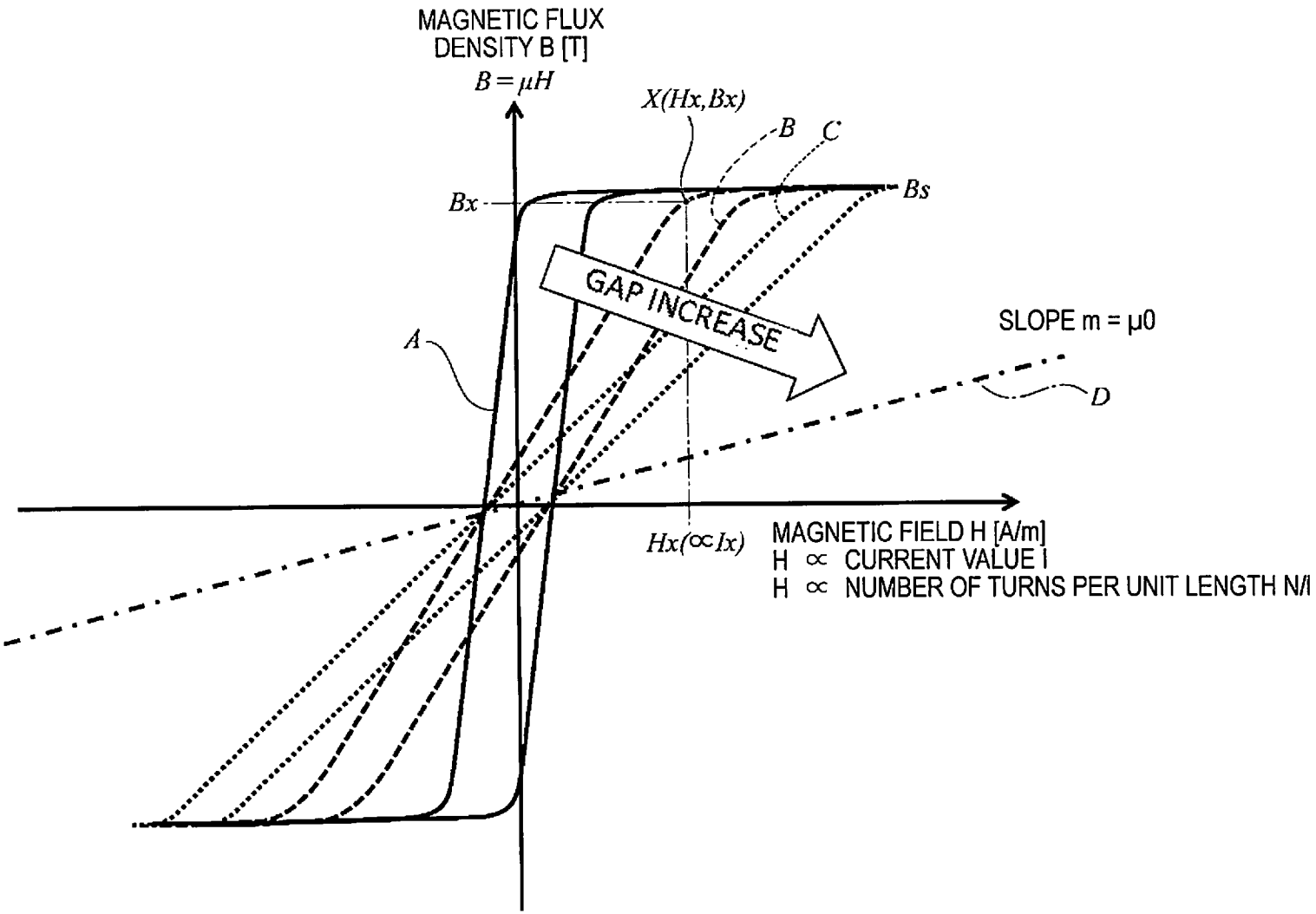
FIG. 4 is an explanatory view illustrating a B-H curve.

FIG. 4 is an explanatory view illustrating the B-H curve. The action of decreasing the slope of the B-H curve will be described below with reference to FIG. 4. In FIG. 4, the horizontal axis is the magnetic field H, and the vertical axis is the magnetic flux density B.

The B-H curve has a magnetic hysteresis characteristic. The absolute value of the magnetic flux density B increases as the absolute value of the magnetic field intensity increases. The magnetic flux density is maintained at a predetermined saturation magnetic flux density Bs, even if the absolute value of the magnetic field intensity reaches a predetermined intensity or higher. The curves A indicated by the solid lines in the figure are the B-H curves when the ferrite core is disposed in the portion that connects the end portions 4*e* of the coil portions 4A-4H to each other and to all the interiors of the coil portions 4A-4H. The curves B indicated by the broken lines in the figure are the B-H curves when the ferrite core 3 is disposed in the portion that connects the end portions 4*e* of the coil portions 4A-4H to each other and to the portions that enter slightly inside the coil portions from the end portions 4*e*. The curves C indicated by the dotted lines are the B-H curves when the ferrite core 3 is disposed in the portion that connects the end portions 4*e* of the coil portions 4A-4H to each other. The straight line D indicated by the single-dotted chain line is the straight line when the ferrite core 3 is not disposed in any of the coil portions 4A-4H. The slope m of this straight line is the vacuum permeability go.

The gap G, which is filled with the member having a lower permeability than the ferrite core 3 (for example, non-magnetic material such as air) inside of each of the coil portions 4A-4H, increases in the following order: curve A→curve B→curve C. That is, the slope of the B-H curve decreases as the gap G increases. That is, when the ferrite cores 3 and the coil portions 4A-4H are regarded as a single magnetic path, the equivalent permeability μ of the entire magnetic path decreases.

Based on the foregoing, a target point X ($H_x$, $B_x$) is set on the curve B for which the magnetic field H follows a path from positive to negative This magnetic flux density % has not reached the saturation magnetic flux density $B_s$ ($B_x<B_s$). As a result, it is possible to obtain a large magnetic flux density $B_x$ with a low current $I_x$ (∝ magnetic field $H_x$) in a region of the curve B in which the magnetic flux density B is not at saturation. That is, it is possible to obtain a large magnetic flux density $B_x$ with a low current $I_x$ while avoiding magnetic saturation of the entire magnetic path.

In the second embodiment, the magnetic fluxes that are generated in accordance with the current flowing through the coil portions 4A-4H, which are formed side by side in the Y-axis direction of the substrate 2, are coupled in series inside each of the coil portions 4A-4H. That is, the magnetic flux that is generated in the coil portion 4A follows a meandering path due to each of the ferrite cores 3 and interlinks the interiors of the other coil portions 4B-4H. Thus, the coil portions 4A-4H are also magnetically coupled to each other in series. As a result, even within the limited dimensions of the substrate 2, it is possible to secure a large number of turns (N) of the coil portions 4A-4H that are connected in series. That is, it is possible to increase the number of turns of each of the coil portions 4A-4H, even when using a coil portion segment (area in which the coil portion is provided) with a low turn density (N/l) in a limited area. Thus, it is possible to achieve both an improvement in the inductance and a reduction in the magnetic flux density.

In the second embodiment, the magnetic fluxes that are generated in accordance with the current flowing through the coil portions 4A-4H, in which the main directions of the magnetic fields that are generated in accordance with the currents are different, are coupled in series between each of the coil portions 4A-4H. That is, the number of turns (N) of the magnetically coupled coil portions 4A-4H, which are connected in series, increases. Thus, it is possible to improve the inductance without increasing the magnetic flux density. In addition, the interiors of the coil portions 4A-4H, excluding the end portions that enclose a portion of each of the ferrite cores 3, are filled with the non-magnetic material (for example, air). As a result, it is possible to lower the permeability of the interiors of the coil portions 4A-4H, from which the magnetic flux is structurally less likely to leak, compared to the end portions. It is thereby possible to avoid magnetic saturation while lowering the permeability of the entire magnetic path.

In the second embodiment, each of the ferrite cores 3 is disposed between each of the coil portions 4A-4H. That is, even if the coil portions 4A-4H are separated from each other, the coil portions are magnetically coupled in series. Thus, the number of turns of the coil portions 4A-4H that are connected in series increases. Therefore, a power inductor 1B with high inductance can be obtained. The other actions are the same as those in the first embodiment, so that the descriptions thereof are omitted.

The effects are described next. The effects listed below can be obtained according to the power inductor 1B of the second embodiment.

(5) A plurality of the coil portions (coil portions 4A-4H) are provided, the plurality of the coil portions (coil portions 4A-4H) are formed side by side in a planar direction of the substrate (substrate 2), and the magnetic flux that is generated in accordance with the current flowing through the plurality of the coil portions (coil portions 4A-4H) are coupled in series inside of the plurality of the coil portions (coil portions 4A-4H) (FIG. 3). Thus, in addition to the effects of (1) to (4) above, it is possible to achieve both an improvement in the inductance and a reduction in the magnetic flux density.

(6) A plurality of the coil portions (coil portions 4A-4H) are provided having different main directions (+X direction, −X direction), and the magnetic flux is generated in accordance with the current flowing through the plurality of the coil portions (coil portions 4A-4H) are coupled in series between the plurality of the coil portions (coil portions 4A-4H) (FIG. 3). Thus, in addition to the effects of (1) to (5) above, it is possible to improve the inductance without increasing the magnetic flux density.

(7) The core portion (ferrite cores 3) is disposed between at least one of the coil portions (coil portions 4A-4H) (FIG. 3). Thus, in addition to the effects of (1) to (6) above, an inductor (power inductor 1B) with high inductance can be obtained.

Third Embodiment

The third embodiment is an example in which outer layer coil portions are disposed on an outer layer of the coil portions via insulating portions.

The configuration is described first. The inductor according to the third embodiment is applied to the power inductor (one example of the inductor) that is connected to the inverter of the motor/generator, in the same manner as in the first embodiment. The "overall configuration," the "dimensional configuration," a "connection configuration," and a "manufacturing method" will be separately described below regarding the configuration of the power inductor according to the third embodiment.

Figure 5:
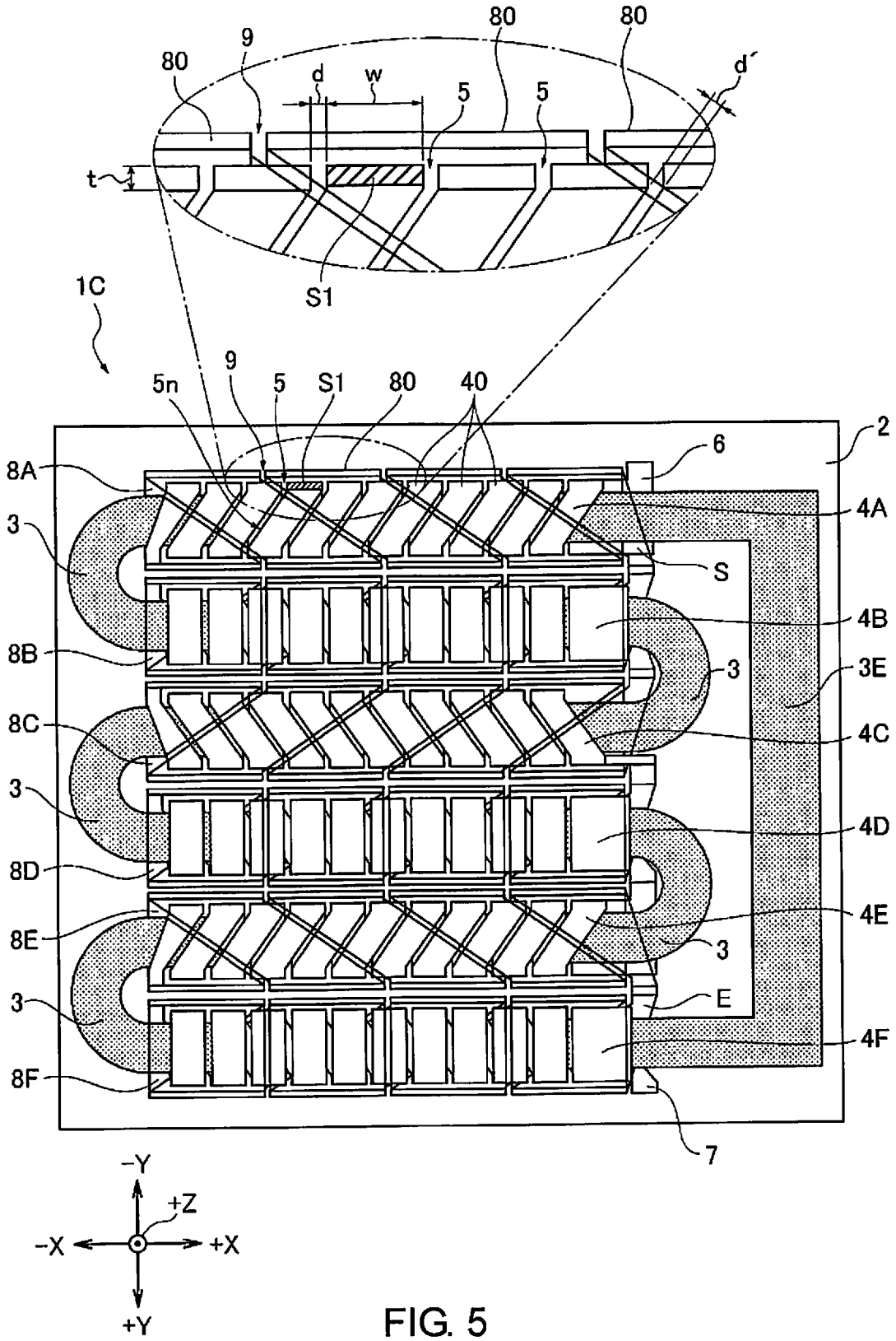
FIG. 5 is a plan view illustrating the overall configuration of the power inductor in a third embodiment, in which the structure of the coil portion is seen from outside of an outer layer coil portion.

FIG. 5 illustrates the overall configuration of the power inductor according to the third embodiment. The overall configuration will be described below with reference to FIG. 5.

A power inductor 1C of the third embodiment is obtained by forming the coil portion that serves as the basic component inside the base material, in the same manner as in the first embodiment. The power inductor 1C is the inductor that uses the substrate 2 of silicon (base material), in the same manner as in the first embodiment. The power inductor 1C comprises a plurality of the ferrite cores 3 (core portions), a plurality of the coil portions 4A-4F (for example, copper), the coil portion inter-turn gaps 5 (insulating portions), the electrode part 6 (terminal portion), the electrode part 7 (terminal portion), and a plurality of the outer layer coil portions 8A-8F (for example, copper).

The substrate 2 serves as the support that supports each of the ferrite cores 3, each of the coil portions 4A-4F, the electrode part 6, the electrode part 7, and each of the outer layer coil portions 8A-8F.

Each of the ferrite cores 3 follows a meandering path and interlinks the magnetic flux generated in each of the coil portions 4A-4F and each of the outer layer coil portions 8A-8F. Each ferrite core 3 is disposed between the coil portions 4A-4F and serves as the magnetic path that connects the coil portions 4A-4F to each other. The ferrite core 3 that connects the winding finish portion E of the coil portion 4H and the winding start portion S of the coil portion 4A is defined as the terminal ferrite core 3E.

Each of the coil portions 4A-4F generates magnetic flux in accordance with the applied current. The coil portions 4A-4F are formed side by side in the Y-axis direction. The inputting of electric current to and the outputting of electric current from the coil portions 4A-4F occurs with respect to electrode 6 and electrode 7, respectively.

The coil portion inter-turn gaps 5 are formed between the conductors 40 of the coil portions 4A-4F. The coil portion inter-turn gaps 5 electrically insulate the adjacent conductors 40 from each other. The coil portion inter-turn gaps 5 are covered with the silicon oxide film, which is not shown. The diagonal element portions 5*n* are portions in which the conductors 40 of the coil portions 4A, 4C, 4E are connected to each other, offset in the X-axis direction.

The electrode part 6 (for example, copper) and the electrode part 7 (for example, copper) connect the ferrite cores 3, the coil portions 4A-4F, and the outer layer coil portions 8A-8F to the outside. The electrode part 6 connects the ferrite cores 3, the coil portions 4A-4F, and the outer layer coil portions 8A-8F to the battery, which is not shown, via the winding start portion S of the coil portion 4A. The electrode part 7 connects the ferrite cores 3, the coil portions 4A-4F, and the outer layer coil portions 8A-8F to the inverter, which is not shown, via the winding finish portion E of the coil portion 4F.

The plurality of the outer layer coil portions 8A-8F generate the magnetic fluxes in accordance with the applied current, in the same manner as the coil portions 4A-4F. The outer layer coil portions 8A-8F are formed side by side in the Y-axis direction. The outer layer coil portions 8A-8F are disposed on the outer layers of the coil portions 4A-4F via the silicon oxide film (insulating portion), which is not shown. Conductors 80 of the outer layer coil portions 8A-8F are disposed on the outer layers of the coil portion inter-turn gaps 5. The positions of coil portion inter-turn gaps 9 and the coil portion inter-turn gaps 5 are shifted in the horizontal plane direction (X-axis direction) of the substrate 2. The coil portion inter-turn gaps 9 are formed between the conductors 80 of the outer layer coil portions 8A-8F. The number (four) of the conductors 80 of the outer layer coil portions 8A-8F is smaller than the number (eleven) of the conductors 40 of the coil portions 4A-4F.

The dimensional configuration will be described below with reference to FIG. 5.

In the coil portions 4A-4F, the width of the rectangular cross-sectional areas S1 is w, in the same manner as in the first embodiment. In the coil portions 4A-4F, the thickness of the rectangular cross-sectional areas S1 is t, in the same manner as in the first embodiment. The width w of the rectangular cross-sectional areas S1 is set larger than the thickness t of the rectangular cross-sectional areas S1, in the same manner as in the first embodiment.

The coil portion inter-turn gap 5 is the width d in the Z-axis direction, in the same manner as in the first embodiment. In the coil portion inter-turn gaps 5, the diagonal element portions 5*n* of the coil portions 4A, 4C, and 4E, have the width d' (d>d'), in the same manner as in the first embodiment. Although obscured and not visible in FIG. 5, the diagonal element portions 5*n* of the coil portions 4B, 4D, and 4F also have the width d' (d>d'). In all regions of the coil portions 4A-4F, both the width w and the thickness t of the rectangular cross-sectional areas S1 of the coil portions 4A-4F are set larger than the width d of the coil portion inter-turn gaps 5, in the same manner as in the first embodiment. That is, the upper limit value of the width w is set to a value with which it is possible to hold the resistance value of each of the coil portions 4A-4F to the desired value or lower. The lower limit value of the width w is set to a value that is greater than the width d of the coil portion inter-turn gaps 5. The upper limit value of the thickness t is set to a value with which it is possible to hold the amount of the leakage magnetic flux to the desired value or lower. The lower limit value of the thickness t is set to a value that is greater than the width d of the coil portion inter-turn gaps 5.

Figure 6:
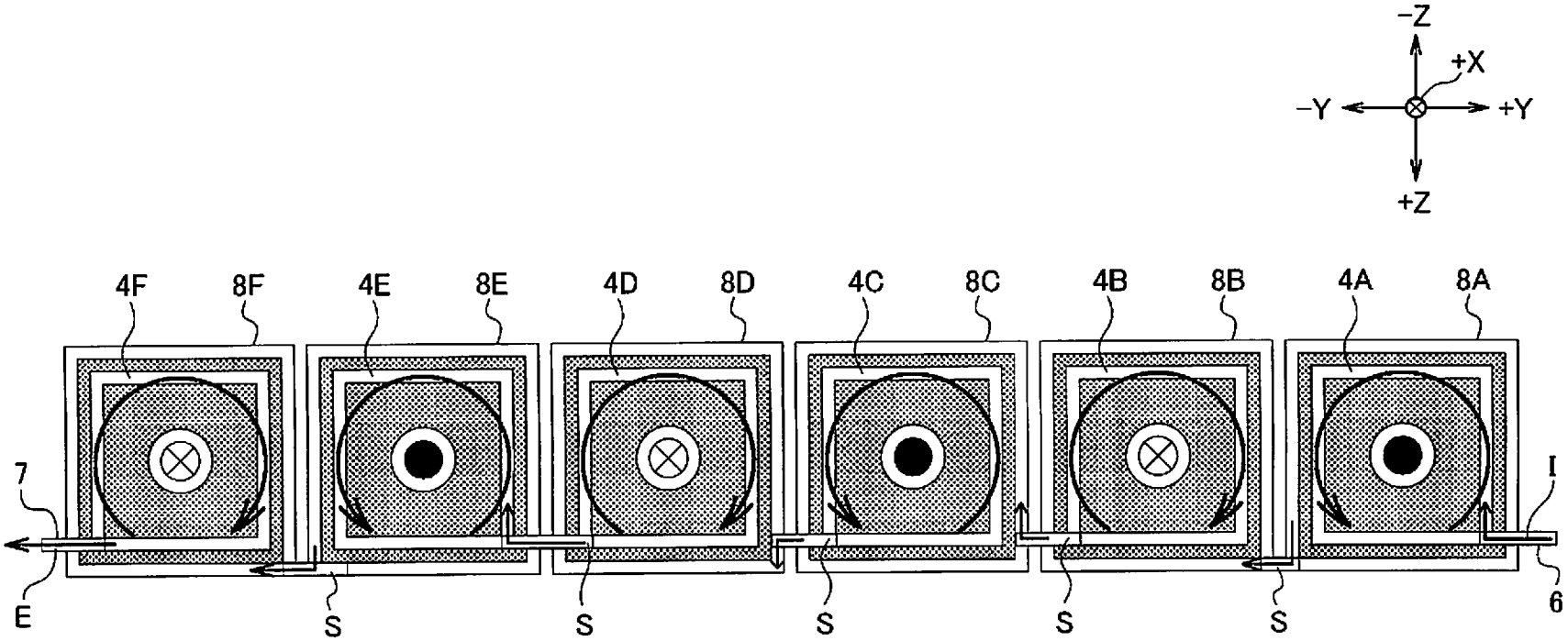
FIG. 6 is a view illustrating a connection configuration of the coil portions and the outer layer coil portions in the third embodiment.

FIG. 6 illustrates the connection configuration of the coil portions and the outer layer coil portions in the third embodiment. The connection configuration will be described below with reference to FIG. 6. Symbols inside the coil portion cross sections of FIG. 6 represent the orientation of the magnetic flux that is generated by the coil portion. This orientation is reversed for each adjacent coil portion.

Each of the outer layer coil portions 8A-8F is connected in series with each of the coil portions 4A-4F. In order to generate oppositely oriented magnetic fluxes in the two-layered coil portion, the coils are turned in the opposite directions. Thus, the coil portion 4A and the coil portion 4B, for example, are structurally different. In addition, in order to connect, without waste, the coil portions 4A-4F, in which the axes of the generated magnetic fields are different, it is preferable to employ a structure in which connecting portions between the coil portions are brought close to each other. In the case of such a connection, since it is possible to gather the portions that connect the coil portions on one side of the coil segment, it is possible to utilize space effectively.

The electric current that flows into the coil portion 4A from the battery, which is not shown, via the electrode part 6 flows through the coil portion 4A in a counterclockwise direction. Subsequently, the current flows through the outer layer coil portion 8A in the counterclockwise direction via the winding finish portion E, which is not shown. The main direction of the magnetic field that is generated in the coil portion 4A in accordance with this current (−X direction) is the same as the main direction of the magnetic field that is generated in the outer layer coil portion 8A (−X direction). Subsequently, the current flows into the outer layer coil portion 8B from the outer layer coil portion 8A via the winding start portion S. Subsequently, the current flows through the outer layer coil portion 8B in a clockwise direction. Subsequently, the current flows into the coil portion 4B via the winding finish portion E, which is not shown. The main direction of the magnetic field that is generated in the coil portion 4B in accordance with this current (+X direction) is the same as the main direction of the magnetic field that is generated in the outer layer coil portion 8B (+X direction). The current then flows into the outer layer coil portion 8C from the coil portion 4B via the winding start portion S. The current then flows in the order of the outer layer coil portion 8C→the coil portion 4C→the outer layer coil portion 8D→the coil portion 4D→the coil portion 4E→the outer layer coil portion 8E→the outer layer coil portion 8F→the coil portion 4F. At this time, the main direction of the magnetic field that is generated in accordance with the current that flows in each of the outer layer coil portions 8C, 8D, 8E, 8F is respectively the same as the main direction of the magnetic field that is generated in accordance with the current that flows in the each of the coil portions 4C, 4D, 4E, 4F. The current then flows into the electrode part 7 from the coil portion 4F via the winding finish portion E. Then, the current is output to the inverter, which is not shown, via the electrode part 7.

Figure 7A:
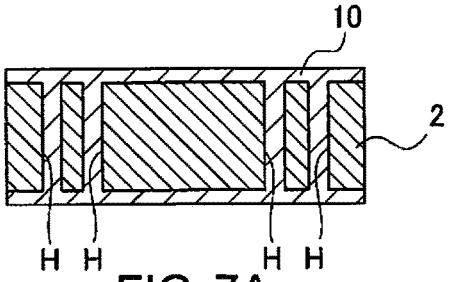
FIG. 7A is a cross-sectional view illustrating a plating process of a manufacturing method of the power inductor according to the third embodiment.
Figure 7B:
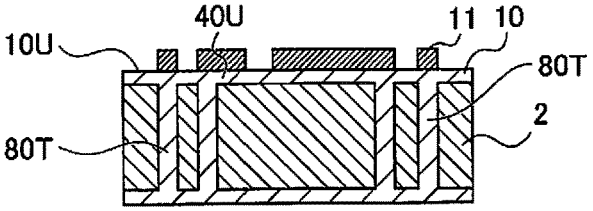
FIG. 7B is a cross-sectional view illustrating a coil portion pattern forming process of the manufacturing method of the power inductor according to the third embodiment.
Figure 7C:
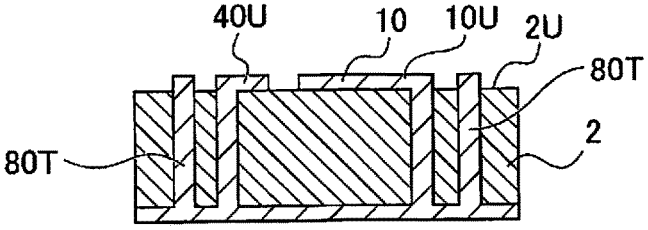
FIG. 7C is a cross-sectional view illustrating an etching process of the manufacturing method of the power inductor according to the third embodiment.
Figure 7D:
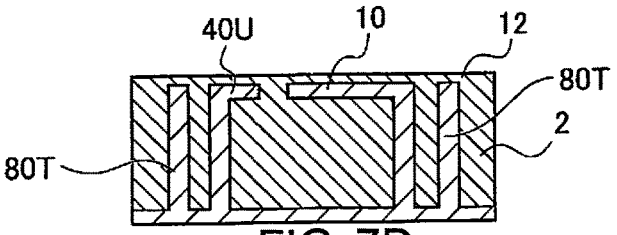
FIG. 7D is a cross-sectional view illustrating an insulating film forming process of the manufacturing method of the power inductor according to the third embodiment.
Figure 7E:
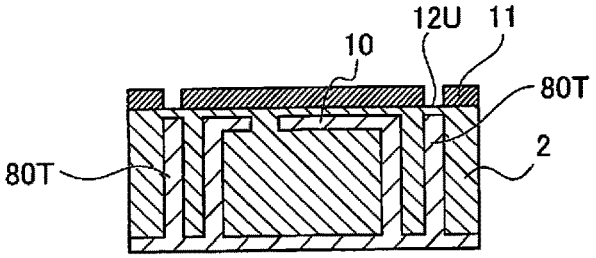
FIG. 7E is a cross-sectional view illustrating the coil portion pattern forming process of the manufacturing method of the power inductor according to the third embodiment.
Figure 7F:
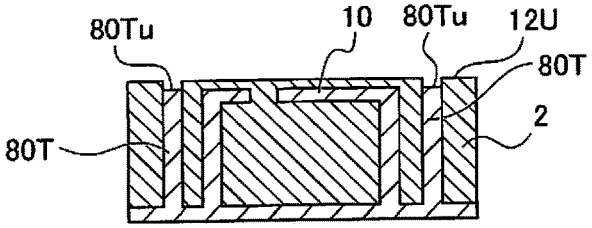
FIG. 7F is a cross-sectional view illustrating the etching process of the manufacturing method of the power inductor according to the third embodiment.
Figure 7G:
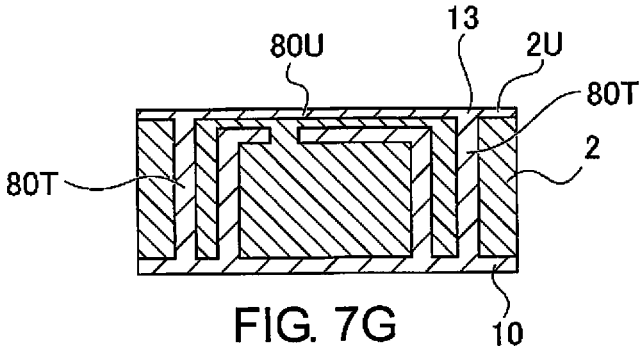
FIG. 7G is a cross-sectional view illustrating a film forming process of the manufacturing method of the power inductor according to the third embodiment.
Figure 7H:
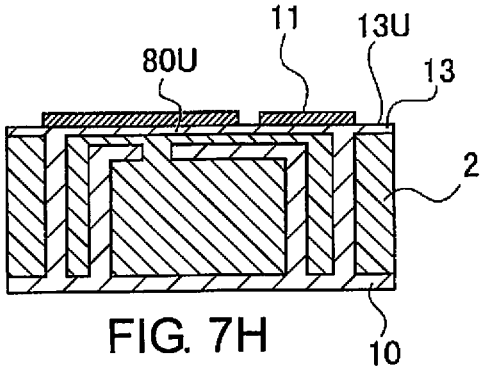
FIG. 7H is a cross-sectional view illustrating the coil portion pattern forming process of the manufacturing method of the power inductor according to the third embodiment.
Figure 7I:
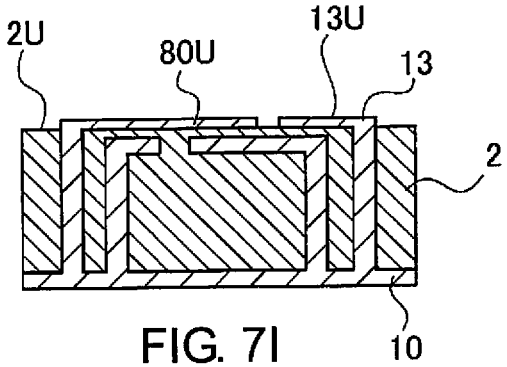
FIG. 7I is a cross-sectional view illustrating the etching process of the manufacturing method of the power inductor according to the third embodiment.
Figure 7J:
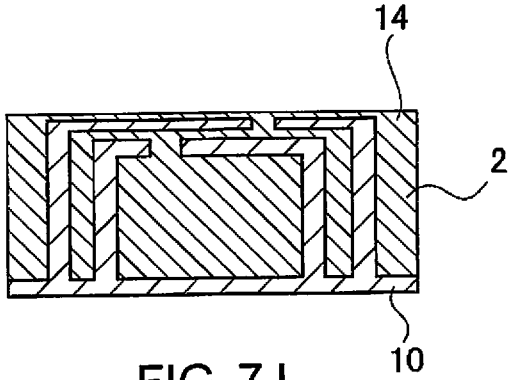
FIG. 7J is a cross-sectional view illustrating the insulating film forming process of the manufacturing method of the power inductor according to the third embodiment.
Figure 7K:
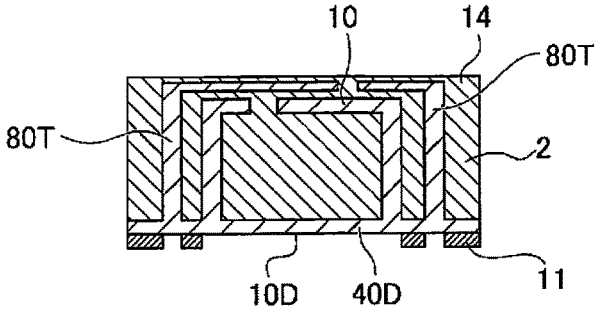
FIG. 7K is a cross-sectional view illustrating the coil portion pattern forming process of the manufacturing method of the power inductor according to the third embodiment.
Figure 7L:
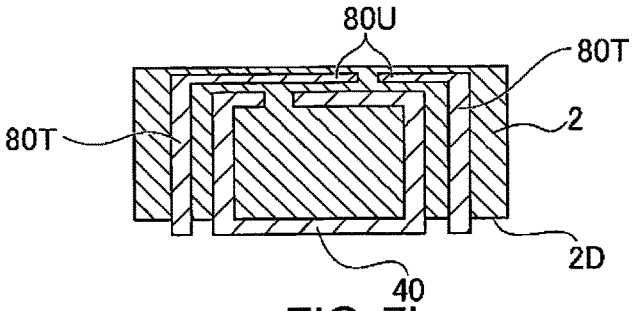
FIG. 7L is a cross-sectional view illustrating the etching process of the manufacturing method of the power inductor according to the third embodiment.
Figure 7M:
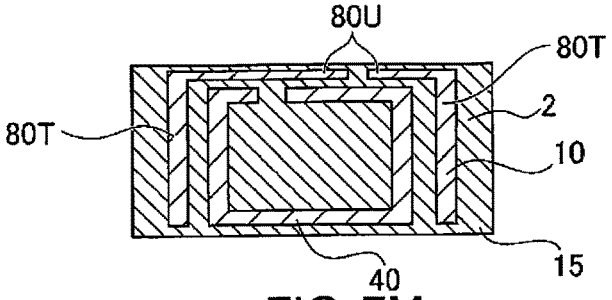
FIG. 7M is a cross-sectional view illustrating the insulating film forming process of the manufacturing method of the power inductor according to the third embodiment.
Figure 7N:
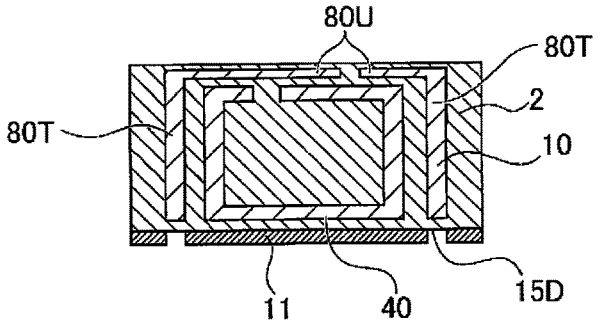
FIG. 7N is a cross-sectional view illustrating the coil portion pattern forming process of the manufacturing method of the power inductor according to the third embodiment.
Figure 7O:
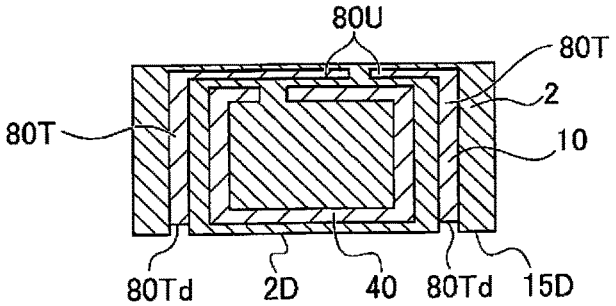
FIG. 7O is a cross-sectional view illustrating the etching process of the manufacturing method of the power inductor according to the third embodiment.
Figure 7P:
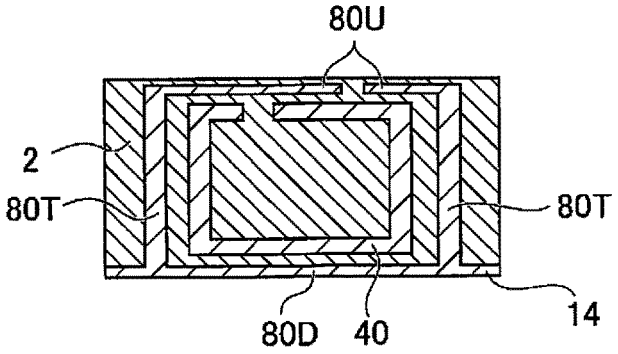
FIG. 7P is a cross-sectional view illustrating a film forming process of the manufacturing method of the power inductor according to the third embodiment.
Figure 7Q:
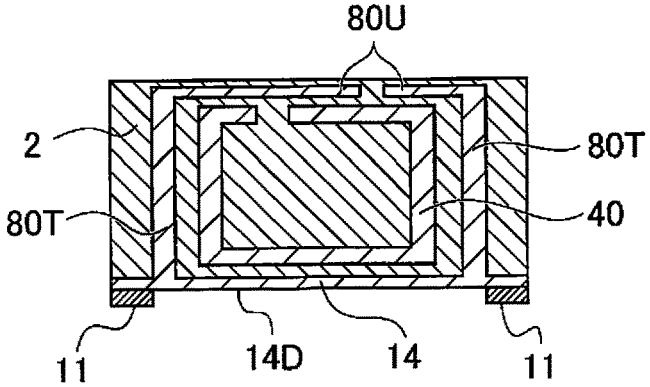
FIG. 7Q is a cross-sectional view illustrating the coil portion pattern forming process of the manufacturing method of the power inductor according to the third embodiment.
Figure 7R:
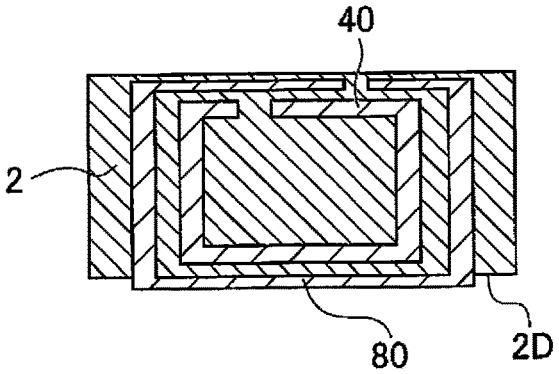
FIG. 7R is a cross-sectional view illustrating the etching process of the manufacturing method of the power inductor according to the third embodiment.
Figure 7S:
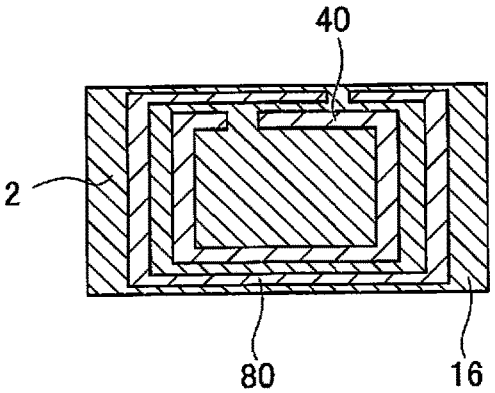
FIG. 7S is a cross-sectional view illustrating the insulating film forming process of the manufacturing method of the power inductor according to the third embodiment.

FIGS. 7A-7S illustrate the manufacturing method of the power inductor according to the third embodiment. The steps that constitute the manufacturing method of the power inductor 1C according to the third embodiment will be described below with reference to FIGS. 7A to 7S. The conductors 40 and the conductors 80 on an upper surface side of the substrate are formed according to an upper surface coil portion forming process, and then the conductors 40 and the conductors 80 on a lower surface side of the substrate are formed according to a lower surface coil portion forming process. In these processes, through-holes are formed in the base material in the thickness direction of the substrate of the coil portion, the through-holes are filled with a conductive plating material, and both the upper and lower surfaces of the substrate are processed using photolithography, to form the inductor. Since it is also possible to embed many conductors in the thickness direction of the substrate, it is possible to achieve both a reduction in leakage magnetic flux and an improvement in current density.

In the upper surface coil portion forming process, first, through-holes H are opened, in which are formed portions of the conductors 40 and the conductors 80 in the thickness direction of the substrate 2, as illustrated in FIG. 7A. Next, in a plating step, the through-holes H are filled with a conductor 10 according to a plating method, in the substrate 2 whose surface is covered with the silicon oxide film, which is not shown.

Subsequently, in a first upper surface pattern forming step, photoresist 11 is applied to an upper surface IOU of the conductor 10, which filled the through-holes H in the plating step, as illustrated in FIG. 7B. Then, in the photoresist 11, a coil pattern, which is not shown, is formed in portions that correspond to the upper surface portion 40U of the conductor 40 and the thickness direction portions 80T of the conductor 80.

Subsequently, in a first upper surface etching step, a coil pattern, which is not shown, is transferred onto the upper surface IOU of the conductor 10 by means of etching utilizing the coil pattern, which is not shown, formed in the first upper surface pattern forming step, as illustrated in FIG. 7C. An upper surface 2U of the substrate 2 is exposed due to the transfer. Then, due to this exposure, an upper surface portion 40U such as shown in FIG. 7C is completed.

Subsequently, in a first upper surface insulating film forming step, the upper surface 2U (refer to FIG. 7C) of the substrate 2 that is exposed in the first upper surface etching step is subjected to a thermal oxidation treatment, as illustrated in FIG. 7D. With the thermal oxidation treatment, an insulating film 12 such as shown in FIG. 7D is formed on the upper surface 2U.

Subsequently, in a second upper surface pattern forming step, the photoresist 11 is coated on an upper surface 12U of the insulating film 12 that is formed in the first upper surface insulating film forming step, as illustrated in FIG. 7E. Then, in the photoresist 11, the coil pattern, which is not shown, is formed in the portions that correspond to the thickness direction portions 80T of the conductor 80. With this formation, the upper surface 12U of the insulating film 12 is exposed.

Subsequently, in the first upper surface etching step, a coil pattern, which is not shown, is transferred onto the upper surface 12U of the insulating film 12 by means of etching utilizing the coil pattern, which is not shown, formed in the second upper surface pattern forming step, as illustrated in FIG. 7F. Upper surfaces 80Tu of the thickness direction portions 80T are exposed due to the transfer.

Subsequently, in a film forming step of an upper surface portion 80U of the conductor 80, a conductor 13 is formed by a CVD method on the upper surfaces 80Tu (refer to FIG. 7F) that are exposed in the first upper surface etching step and the upper surface 2U of the substrate 2, as illustrated in FIG. 7G. With this film formation, the thickness direction portions 80T of the conductor 80 are electrically connected to each other via the upper surface portion 80U.

Subsequently, in a third upper surface pattern forming step, the photoresist 11 is coated on an upper surface 13U of the conductor 13 that is formed in the film forming step of the upper surface portion 80U of the conductor 80, as illustrated in FIG. 7H. Then, in the photoresist 11, the coil pattern, which is not shown, is formed in the portion that corresponds to the upper surface portion 80U of the conductor 80, in the same manner as in FIG. 7B.

Subsequently, in a second upper surface etching step, the coil pattern, which is not shown, is transferred onto the upper surface 13U of the conductor 13 by means of etching utilizing the coil pattern, which is not shown, formed in the third upper surface pattern forming step, as illustrated in FIG. 7I. The upper surface 2U of the substrate 2 is exposed due to the transfer, in the same manner as in FIG. 7C. Due to this exposure, the upper surface portion 80U of the conductor 80, such as shown in FIG. 7I, is completed.

Subsequently, in a second upper surface insulating film forming step, the upper surface 2U (refer to FIG. 7I) of the substrate 2 that is exposed in the second upper surface etching step is subjected to a thermal oxidation treatment, as illustrated in FIG. 7J. With the thermal oxidation treatment, an insulating film 14 is formed on the upper surface 2U. The upper surface coil portion forming process is thereby completed.

Subsequently, in a first lower surface pattern forming step, the photoresist 11 is coated on a lower surface 10D the conductor 10 on the lower surface side of the substrate 2, where the insulating film 14 is formed in the second upper surface insulating film forming step, as illustrated in FIG. 7K. Then, in the photoresist 11, the coil pattern, which is not shown, is formed in portion that corresponds to a lower surface portion 40D of the conductor 40 and the thickness direction portions 80T of the conductor 80.

Subsequently, in a first lower surface etching step, the coil pattern, which is not shown, is transferred onto the lower surface 10D of the conductor 10 by means of etching utilizing the coil pattern, which is not shown, formed in the first lower surface pattern forming step, as illustrated in FIG. 7L. A lower surface 2D of the substrate 2 is exposed due to the transfer, Due to the exposure, the conductor 40, such as shown in FIG. 7L, is completed.

Subsequently, in a first lower surface insulating film forming step, the lower surface 2D (refer to FIG. 7L) of the substrate 2 that is exposed in the first lower surface etching step is subjected to a thermal oxidation treatment, as illustrated in FIG. 7M. With the thermal oxidation treatment, an insulating film 15 is formed on the lower surface 2D.

Subsequently, in a second lower surface pattern forming step, the photoresist 11 is coated on a lower surface 15D of the insulating film 15 that is formed in the first lower surface insulating film forming step, as illustrated in FIG. 7N. Then, in the photoresist 11, the coil pattern, which is not shown, is formed in the portions that correspond to the thickness direction portions 80T of the conductor 80. With this formation, the lower surface 15D of the insulating film 15 is exposed.

Subsequently, in a second lower surface etching step, the coil pattern, which is not shown, is transferred onto the lower surface 15D of the insulating film 15 by means of etching utilizing the coil pattern, which is not shown, formed in the second lower surface pattern forming step, as illustrated in FIG. 7O. Lower surfaces 80Td of the thickness direction portions 80T are exposed due to the transfer.

Subsequently, in a film forming step of lower surface portion 80D of the conductor 80, a conductor 14 is formed by the CVD method on the lower surfaces 80Td (refer to FIG. 7O) that are exposed in the second lower surface etching step and the lower surface 2D of the substrate 2 (refer to FIG. 7O), as illustrated in FIG. 7P. With this film formation, the thickness direction portions 80T of the conductor 80 are electrically connected to each other via the lower surface portion 80D.

Subsequently, in a third lower surface pattern forming step, the photoresist 11 is coated on a lower surface 14D of the conductor 14 that is formed in the film forming step of the lower surface portion 80D of the conductor 80, as illustrated in FIG. 7Q. Then, in the photoresist 11, the coil pattern, which is not shown, is formed in the portion that corresponds to the lower surface portion 80D of the conductor 80.

Subsequently, in a third lower surface etching step, the coil pattern, which is not shown, is transferred onto the lower surface 14D of the conductor 14 by means of etching utilizing the coil pattern, which is not shown, formed in the third lower surface pattern forming step, as illustrated in FIG. 7R. The lower surface 2D of the substrate 2 is exposed due to the transfer, in the same manner as in FIG. 7L. Due to this exposure, the conductor 80, such as shown in FIG. 7R, is completed.

Subsequently, in a second lower surface insulating film forming step, the lower surface 2D (refer to FIG. 7R) of the substrate 2 that is exposed in the third lower surface etching step is subjected to a thermal oxidation treatment, as illustrated in FIG. 7S. With the thermal oxidation treatment, an insulating film 16 is formed on the lower surface 2D. The lower surface coil portion forming process is thereby completed. Although not shown, a planarization treatment, such as the CMP (Chemical Mechanical Polishing) method, can be appropriately added to the upper surface coil portion forming process and the lower surface coil portion forming process.

The characteristic action of the power inductor 1C will be described next. In the third embodiment, the main directions of the magnetic fields that are generated in accordance with the current flowing through the outer layer coil portions 8A-8F are respectively the same as the main directions of the magnetic fields that are generated in accordance with the current flowing through the coil portions. That is, by forming double-layered coil portions, the turn density (N/l) increases. Therefore, it is possible to obtain a higher inductance compared to a case in which the coil portion is single-layered.

In the third embodiment, the conductors 80 of the outer layer coil portions 8A-8F are disposed on the outer layers of the coil portion inter-turn gaps 5, which are formed between the conductors 40 of the coil portions 4A-4F. That is, the coil portion inter-turn gaps 5, which act as paths through which the magnetic fluxes that are generated by the coil portions 4A-4F leak (leakage magnetic flux path), are shaped to be blocked by the conductors of the outer layer coil portions 8A-8F. Thus, it is possible to obtain higher inductance since the leakage magnetic flux from the coil portion inter-turn gaps 5 can be reduced.

In the third embodiment, the number (four) of the conductors 80 of the outer layer coil portions 8A-8F is smaller than the number (eleven) of the conductors 40 of the coil portions 4A-4F. That is, the number of the coil portion inter-turn gaps 9 is reduced compared to the coil portion inter-turn gaps 5. As a result, the number between turns of the outer layer coil portions 8A-8F is reduced, while the leakage magnetic flux from the coil portion inter-turn gaps 5 is reduced by the conductors 80 of the outer layer coil portions 8A-8F. As a result, the leakage magnetic flux of the entire power inductor 1C is reduced. Therefore, a power inductor 1C with high inductance can be obtained.

In the third embodiment, the outer layer coil portions 8A-8F are respectively connected in series with the coil portions 4A-4F. That is, it becomes possible to interlink the coil portions 4A-4F and the magnetic fluxes that are generated in the outer layer coil portions 8A-8F via the outer layer coil portions 8A-8F and the coil portions 4A-4F. It is thereby possible to suppress the leakage magnetic flux even in the absence of magnetic material within the coil portion. Thus, it is possible to suppress the leakage magnetic flux even in a structure in which the permeability inside the coil portion is low and the magnetic flux leaks easily through the coil portion inter-turn gaps 5. In addition, since the coil portions and the outer layer coil portions are connected in series and the connecting portions are at one end, connection to the plurality of coil is facilitated, so that the inductance density can be improved. The other actions are the same as those in the first embodiment, so that the descriptions thereof are omitted.

The effects are described next. The effects listed below can be obtained according to the power inductor 1C of the third embodiment.

(8) At least one of the outer layer coil portion (outer layer coil portions 8A-8F) is provided that is disposed on an outer layer of the coil portions (coil portions 4A-4F) via insulating portions (conductors 80), and the main directions of the magnetic fields that are generated in accordance with the current flowing through the outer layer coil portions (outer layer coil portions 8A-8F) are the same as the main directions of the magnetic fields that are generated in accordance with the current flowing through the coil portions (coil portions 4A-4F) (FIG. 6). Thus, in addition to the effects of (1) to (7) above, it is possible to obtain a higher inductance compared to a case in which the coil portion is single-layered.

(9) The conductors (conductors 80) of the outer layer coil portions (outer layer coil portions 8A-8F are disposed on the outer layers of the insulating portions (coil portion inter-turn gaps 5), which are formed between the conductors (conductors 40) of the coil portions (coil portions 4A-4F) (FIG. 5). Thus, in addition to the effects of (1) to (8) above, it is possible to obtain a higher inductance, because it is possible to reduce the leakage magnetic flux from the insulating portions (coil portion inter-turn gaps 5).

(10) The number of the conductors (conductors 80) of the outer layer coil portions (outer layer coil portions 8A-8F) is less than the number of the conductors (conductors 40) of the coil portions (coil portions 4A-4F) (FIG. 5). Thus, in addition to the effects of (1) to (9) above, an inductor (power inductor 1C) with high inductance can be obtained.

(11) The outer layer coil portions (outer layer coil portions 8A-8F) are connected in series with the coil portions (coil portions 4A-4F) (FIGS. 5 and 6). Thus, in addition to the effects of (1) to (10) above, it is possible to suppress the leakage magnetic flux even in a structure in which the permeability inside the coil portions (coil portions 4A-4F) is low and the magnetic flux readily leaks through the insulating portions (coil portion inter-turn gaps 5).

Fourth Embodiment

The fourth embodiment is an example in which a plurality of series-connected coil portions and a plurality of series-connected outer layer coil portions are connected in parallel.

The configuration is described first. The inductor according to the fourth embodiment is applied to the power inductor (one example of the inductor) that is connected to the inverter of the motor/generator, in the same manner as in the first embodiment. The "overall configuration," the "dimensional configuration," and the "connection configuration" will be separately described below regarding the configuration of the power inductor according to the fourth embodiment.

Figure 8:
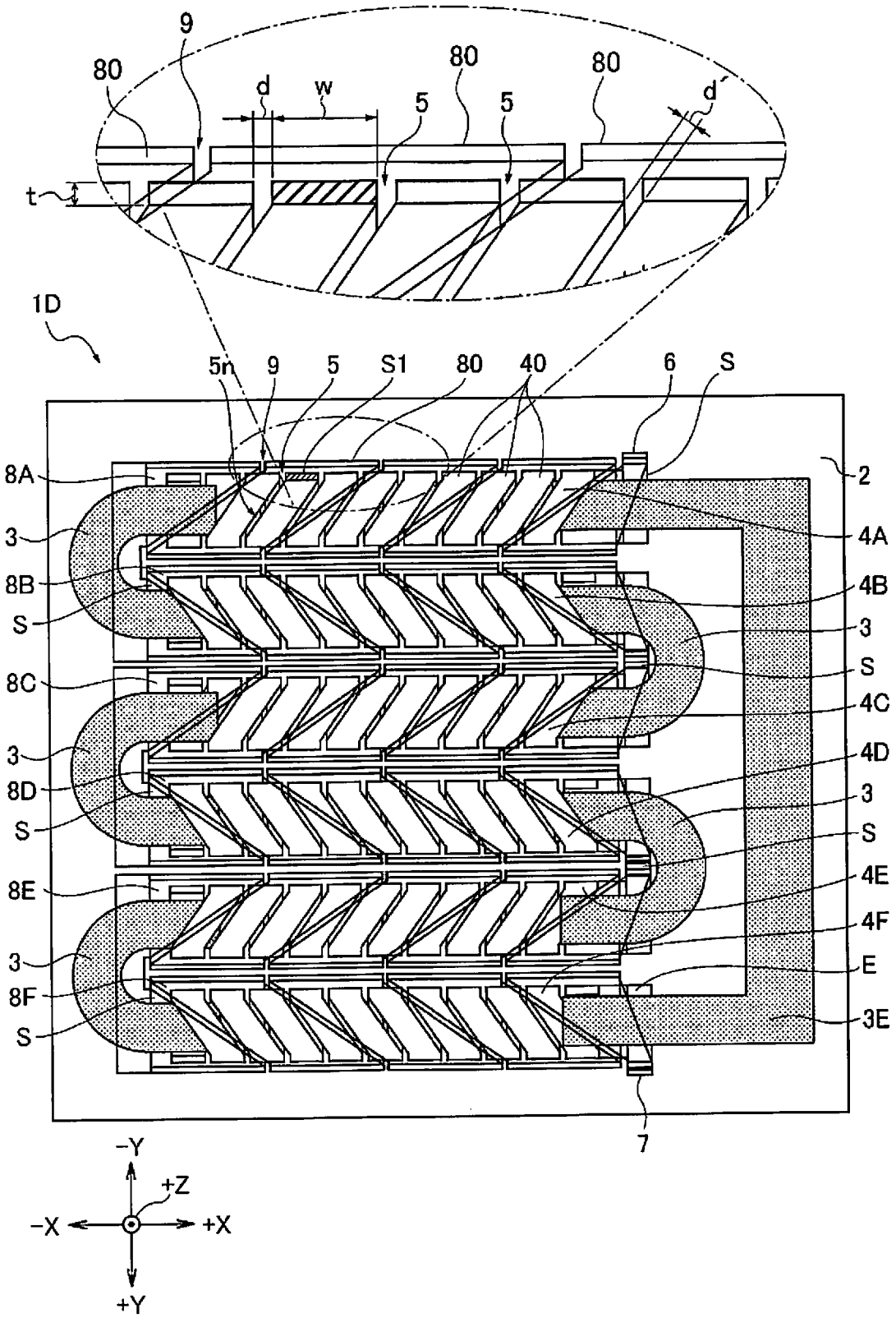
FIG. 8 is a plan view illustrating the overall configuration of the power inductor in a fourth embodiment, in which the structure of the coil portion is seen through from the outside of the outer layer coil portion.

FIG. 8 illustrates the overall configuration of the power inductor according to the fourth embodiment. The overall configuration will be described below with reference to FIG. 8.

A power inductor 1D of the fourth embodiment is obtained by forming the coil portion that serves as the basic component inside of the base material, in the same manner as in the first embodiment. The power inductor 1D is the inductor that uses the substrate 2 of silicon (base material), in the same manner as in the first embodiment. The power inductor 1D comprises a plurality of the ferrite cores 3 (core portions), a plurality of the coil portions 4A-4F (for example, copper), the coil portion inter-turn gaps 5 (insulating portions), the electrode part 6 (terminal portion), the electrode part 7 (terminal portion), and a plurality of the outer layer coil portions 8A-8F (for example, copper). The winding start portions S in FIG. 8 indicate the winding start portion S of each of the coil portions 4A-4F and each of the outer layer coil portions 8A-8F. The winding finish portions E indicate the winding finish portion E of each of the coil portions 4A-4F and each of the outer layer coil portions 8A-8F.

The substrate 2 serves as the support that supports each of the ferrite cores 3, each of the coil portions 4A-4F, the electrode part 6, the electrode part 7, and each of the outer layer coil portions 8A-8F.

Each of the ferrite cores 3 follows a meandering path and interlinks the magnetic flux that is generated in each of the coil portions 4A-4F and each of the outer layer coil portions 8A-8F. Each ferrite core 3 is disposed between the coil portions 4A-4F and serves as the magnetic path that interconnects the coil portions 4A-4F to each other. The ferrite core 3 that connects the winding finish portion E of the coil portion 4F and the winding start portion S of the coil portion 4A is defined as the terminal ferrite core 3E.

Each of the coil portions 4A-4F generates magnetic flux in accordance with the applied current. The coil portions 4A-4F are formed side by side in the Y-axis direction. The inputting of electric current to and the outputting of electric current from the coil portions 4A-4F occurs with respect to electrode 6 and electrode 7, respectively.

The coil portion inter-turn gaps 5 are formed between the conductors 40 of the coil portions 4A-4F. The coil portion inter-turn gaps 5 electrically insulate the adjacent conductors 40 from each other. The coil portion inter-turn gaps 5 are covered with the silicon oxide film, not shown. The diagonal element portions 5*n* are portions in which the adjacent conductors 40 are interconnected, offset in the X-axis direction.

The electrode part 6 (for example, copper) and the electrode part 7 (for example, copper) connect the ferrite cores 3, the coil portions 4A-4F, and the outer layer coil portions 8A-8F to the outside. The electrode part 6 connects the ferrite cores 3, the coil portions 4A-4F, and the outer layer coil portions 8A-8F to the battery, which is not shown, via the winding start portion S of the coil portion 4A. The electrode part 7 connects the ferrite cores 3, the coil portions 4A-4F, and the outer layer coil portions 8A-8F to the inverter, which is not shown, via the winding finish portion E of the coil portion 4F.

The plurality of the outer layer coil portions 8A-8F generate the magnetic fluxes in accordance with the applied current, in the same manner as the coil portions 4A-4F. The outer layer coil portions 8A-8F are formed side by side in the Y-axis direction. The outer layer coil portions 8A-8F are disposed on the outer layers of the coil portions 4A-4F via the silicon oxide film (insulating portion), not shown. Conductors 80 of the outer layer coil portions 8A-8F are disposed on the outer layers of the coil portion inter-turn gaps 5. The positions of coil portion inter-turn gaps 9 and the coil portion inter-turn gaps 5 are shifted in the horizontal plane direction (X-axis direction) of the substrate 2. The coil portion inter-turn gaps 9 are formed between the conductors 80 of the outer layer coil portions 8A-8F. The number (four) of the conductors 80 of the outer layer coil portions 8A-8F is less than the number (eleven) of the conductors 40 of the coil portions 4A-4F.

The dimensional configuration will be described below with reference to FIG. 8.

In the coil portions 4A-4F, the width of the rectangular cross-sectional areas S1 is w, in the same manner as in the first embodiment. In the coil portions 4A-4F, the thickness of the rectangular cross-sectional areas S1 is t, in the same manner as in the first embodiment. The width w of the rectangular cross-sectional areas S1 is set larger than the thickness t of the rectangular cross-sectional areas S1, in the same manner as in the first embodiment.

The coil portion inter-turn gap 5 is the width d in the Z-axis direction, in the same manner as in the first embodiment. In the coil portion inter-turn gaps 5, the diagonal element portions 5*n* have the width d' (d>d') in the same manner as in the first embodiment. In all of the regions of the coil portions 4A-4F, both the width w and the thickness t of the rectangular cross-sectional areas S1 of the coil portions 4A-4F are set larger than the width d of the coil portion inter-turn gaps 5, in the same manner as in the first embodiment. That is, the upper limit value of the width w is set to a value with which it is possible to hold the resistance value of each of the coil portions 4A-4F to the desired value or lower. The lower limit value of the width w is set to a value that is greater than the width d of the coil portion inter-turn gaps 5. The upper limit value of the thickness t is set to a value with which it is possible to hold the amount of the leakage magnetic flux to the desired value or lower. The lower limit value of the thickness t is set to a value that is greater than the width d of the coil portion inter-turn gaps 5.

The connection configuration will be described below with reference to FIG. 8.

The coil portions 4A-4F are connected in series to each other via the winding start portion S. The outer layer coil portions are also connected in series to each other via the winding start portion S. The series-connected coil portions 4A-4F and the series-connected outer layer coil portions 8A-8F are connected in parallel.

The electric current that flows into winding start portion S of the outer layer coil portion 8A and the coil portion 4A from the battery, which is not shown, via the electrode part 6, is branched into the coil portion 4A side and the outer layer coil portion 8A side. The electric current that flows into the coil portion 4A side flows through the coil portion 4A in a counterclockwise direction with respect to the X-axis direction. The electric current that flows into the outer layer coil portion 8A side also flows through the outer layer coil portion 8A in a counterclockwise direction with respect to the X-axis direction. Thus, the main direction of the magnetic field that is generated in the coil portion 4A (−X direction) is the same as the main direction of the magnetic field that is generated in the outer layer coil portion 8A (−X direction).

Subsequently, the current that has passed through the coil portion 4A and the current that has passed through the outer layer coil portion 8A initially merge at the winding start portion S of the outer layer coil portion 8B and the coil portion 4B and then re-branch. The electric current that flows into the coil portion 4B side flows through the coil portion 4B in a clockwise direction with respect to the X-axis direction. The electric current that flows into the outer layer coil portion 8B side also flows through the outer layer coil portion 8B in a clockwise direction with respect to the X-axis direction. Thus, the main direction of the magnetic field that is generated in the coil portion 4B (+X direction) is the same as the main direction of the magnetic field that is generated in the outer layer coil portion 8B (+X direction).

Subsequently, the current that has finished flowing through the coil portion 4B and the current that has finished flowing through the outer layer coil portion 8B temporarily merge at the winding start portion S of the outer layer coil portion 8C and the coil portion 4C, and then continue to branch and merge. That is, the current that has finished flowing through the coil portion 4B flows in the following order: coil portion 4C→coil portion 4D→coil portion 4E→coil portion 4F. The current that has passed through the outer layer coil portion 8B flows in the following order: outer layer coil portion 8C→outer layer coil portion 8D→outer layer coil portion 8E→outer layer coil portion 8F. At this time, the main direction of the magnetic field that is generated in each of the coil portions 4C, 4D, 4E, 4F is respectively the same as the main direction of the magnetic field that is generated in the each of the outer layer coil portions 8C, 8D, 8E, 8F. Subsequently, the electric current that has merged at the winding finish portion E of the outer layer coil portion 8F and the coil portion 4F is output to the inverter, which is not shown, via the electrode part 7.

The actions are described next. "Dispersion action of the generated heat amount" and "characteristic action of the power inductor 1D" will be described separately regarding the actions of the power inductor 1D according to the first embodiment.

It is assumed that the relationship $N_0>N_1$ holds when the number of series connections of the outer layer coil portions 8A-8F is No and the number of series connections of the coil portions 4A-4F is $N_1$. It should be noted that, with respect to the switching frequency of the electric power converter to which the power inductor 1D according to the fourth embodiment is applied, the impedance of the plurality of series-connected coil portions 4A-4F and the impedance of the series-connected outer layer coil portions 8A-8F are structured to be essentially the same. When the magnetic flux density B is the same, the inductance value L is proportional to the number of turns N. Assuming that, at the switching frequency, the thickness of the coil cross section is less than the skin depth and the skin effect can be ignored, when the following approximation (3) is basically satisfied, the impedance will be essentially the same. The inductance $L_0$ in the relational expression (3) is the inductance per unit turn of the coil.

$$R_o+2\pi f N_o L_o \approx R_i+2\pi f N_i L_o \quad (3)$$

Here, the "switching frequency" refers to one of the circuit specifications of a switching regulator.

That is, the coil portion cross-sectional area of the outer layer coil portions 8A-8F is smaller than the coil cross-sectional area of the coil portions 4A-4F. Thus, the current of the switching frequency component flows uniformly between the coil portions 4A-4F and the outer layer coil portions 8A-8F. As a result, the heat generated by the coil portions 4A-4F and the outer layer coil portions 8A-8F is dispersed. The directions of the currents that flow through the coil portions 4A-4F and the outer layer coil portions 8A-8F are the same as those in FIG. 6. The connecting portions between the plurality of the series-connected coil portions 4A-4F and the outer layer coil portions 8A-8F are disposed at both ends of the coil portions 4A-4F and the outer layer coil portions 8A-8F.

In the fourth embodiment, the series-connected coil portions 4A-4F and the series-connected outer layer coil portions 8A-8F are connected in parallel. That is, the current flows uniformly between the coil portions 4A-4F and the outer layer coil portions 8A-8F. Thus, it is possible to improve the current density that can be applied to the power inductor 1D. In addition, the coil portion cross-sectional area of the outer layer coil portions 8A-8F is smaller than the coil cross-sectional area of the coil portions 4A-4F. Thus, the current of the switching frequency component flows uniformly between the coil portions 4A-4F and the outer layer coil portions 8A-8F. As a result, the heat generated by the coil portions 4A-4F and the outer layer coil portions 8A-8F is dispersed. The other actions are the same as those in the first embodiment, so that the descriptions thereof are omitted.

The effects will now be described. The effects listed below can be obtained according to the power inductor 1D of the fourth embodiment.

(12) The plurality of coil portions (coil portions 4A-4F) are connected together in series, the plurality of outer layer coil portions (outer layer coil portions 8A-8F) are connected together in series, and the plurality of series-connected coil portions (coil portions 4A-4F) and the plurality of series-connected outer layer coil portions (outer layer coil portions 8A-8F) are connected in parallel (FIG. 8). Thus, in addition to the effects of (1) to (10) above, it is possible to improve the current density that can be applied to the inductor (power inductor 1D).

Fifth Embodiment

The fifth embodiment is an example in which the width of the rectangular cross-sectional area of the coil portion increases with decreasing distance to the center of the substrate.

The configuration is described first. The inductor according to the fifth embodiment is applied to the power inductor (one example of the inductor) that is connected to the inverter of the motor/generator, in the same manner as in the first embodiment. The "overall configuration" and the "dimensional configuration" will be described separately below regarding the configuration of the power inductor according to the fifth embodiment.

Figure 9:
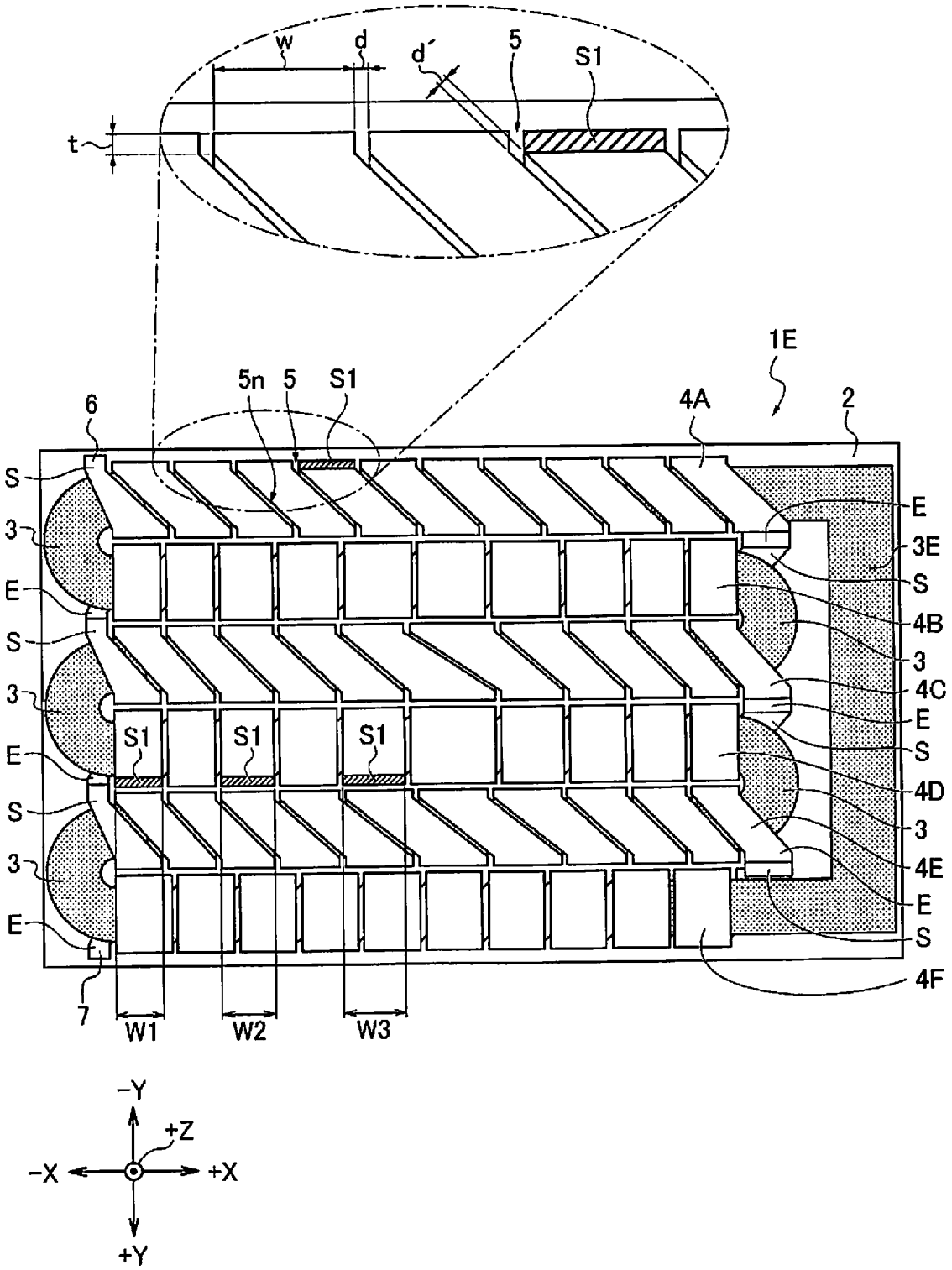
FIG. 9 is a plan view illustrating the overall configuration of the power inductor according to a fifth embodiment.

FIG. 9 illustrates the overall configuration of the power inductor according to the fifth embodiment. The overall configuration will be described below with reference to FIG. 9.

A power inductor 1E of the fifth embodiment is obtained by forming the coil portion that serves as the basic component inside of the base material, in the same manner as in the first embodiment. The power inductor 1E is the inductor that uses the substrate 2 of silicon (base material), in the same manner as in the first embodiment. The power inductor 1E comprises a plurality of the ferrite cores 3 (core portions), a plurality of the coil portions 4A-4F (for example, copper), the coil portion inter-turn gaps 5 (insulating portions), the electrode part 6 (terminal portion), and the electrode part 7 (terminal portion). The winding start portions S in FIG. 9 indicate the winding start portion S of each of the coil portions 4A-4F. The winding finish portions E indicate the winding finish portion E of each of the coil portions 4A-4F.

The substrate 2 serves as the support that supports each of the ferrite cores 3, each of the coil portions 4A-4H, the electrode part 6, and the electrode part 7. The substrate 2 has a rectangular outer shape.

Each of the ferrite cores 3 follows a meandering path and interlinks the magnetic flux that is generated by each of the coil portions 4A-4F. Each ferrite core 3 is disposed between the coil portions 4A-4F and serves as the magnetic path that interconnects the coil portions 4A-4F. The ferrite core 3 that connects the winding finish portion E of the coil portion 4F and the winding start portion S of the coil portion 4A is defined as the terminal ferrite core 3E.

Each of the coil portions 4A-4F generates magnetic flux in accordance with the applied current. The coil portions 4A-4F are formed side by side in the Y-axis direction on the plane of the substrate 2. The coil portions 4A-4F are connected together in series. The inputting of electric current to and the outputting of electric current from the coil portions 4A-4F occurs with respect to electrode 6 and electrode 7, respectively. That is, the electric current that is input from the electrode 6 via the winding start portion S of the coil portion 4A flows through the coil portions 4A-4F and is output to the outside from the electrode 7 via the winding finish portion E of the coil portion 4F. In addition, the main directions of the magnetic fields that are generated in accordance with the electric current are different between the coil portions 4B, 4D, and 4F and the coil portions 4A, 4C, 4E, and 4G. That is, the main direction of the magnetic fields that are generated in the coil portions 4B, 4D, and 4F is the +X direction. The main direction of the magnetic fields that are generated in the coil portions 4A, 4C, and 4E is the −X direction.

The coil portion inter-turn gaps 5 are formed between the conductors 40 of the coil portions 4A-4F. The coil portion inter-turn gaps 5 electrically insulate the adjacent conductors 40 from each other. The coil portion inter-turn gaps 5 are covered with the silicon oxide film, not shown.

The electrode part 6 (for example, copper) and the electrode part 7 (for example, copper) connect the ferrite cores 3 and the coil portions 4A-4F to the outside. The electrode part 6 connects the ferrite cores 3 and the coil portions 4A-4F to the battery, which is not shown, via the winding start portion S of the coil portion 4A. The electrode part 7 connects the ferrite cores 3 and the coil portions 4A-4F to the inverter, which is not shown, via the winding finish portion E of the coil portion 4F.

The dimensional configuration will be described below with reference to FIG. 9.

In the coil portions 4A-4F, the width of the rectangular cross-sectional areas S1 is w, in the same manner as in the first embodiment. In the coil portions 4A-4F, the thickness of the rectangular cross-sectional areas S1 is t, in the same manner as in the first embodiment. The width w of the rectangular cross-sectional areas S1 is set larger than the thickness t of the rectangular cross-sectional areas S1, in the same manner as in the first embodiment.

The coil portion inter-turn gap 5 is the width d in the Z-axis direction, in the same manner as in the first embodiment. With respect to the coil portion inter-turn gaps 5, the diagonal element portions 5*n* in which the conductors 40 of the coil portions 4A, 4C, 4E are interconnected, offset in the X-axis direction, have the width d' (d>d'), in the same manner as in the first embodiment. Although obscured and not visible in FIG. 9, the diagonal element portions 5*n* in which the conductors 40 of the coil portions 4B, 4D, and 4F are interconnected, offset in the X-axis direction, also have the width d' (d>d'). In all regions of the coil portions 4A-4F, both the width w and the thickness t of the rectangular cross-sectional areas S1 of the coil portions 4A-4F are set larger than the width d of the coil portion inter-turn gaps 5, in the same manner as in the first embodiment. That is, the upper limit value of the width w is set to a value with which it is possible to hold the resistance value of each of the coil portions 4A-4F to the desired value or lower. The lower limit value of the width w is set to a value that is greater than the width d of the coil portion inter-turn gaps 5. The upper limit value of the thickness t is set to a value with which it is possible to hold the amount of the leakage magnetic flux to the desired value or lower. The lower limit value of the thickness t is set to a value that is greater than the width d of the coil portion inter-turn gaps 5.

The width w of the rectangular cross-sectional areas S1 of the coil portion 4D increases with decreasing distance to the center of the substrate 2 in the +X direction (w3>w2>w1).

The actions will now be described. "Basic action of lowering the temperature" and "characteristic action of the power inductor 1E" will be described separately regarding the actions of the power inductor 1E according to the fifth embodiment.

In the power inductor 1E, when the plurality of coil portions are arranged, the cross-sectional areas of the coil portions in the central portion of the power inductor substrate are made larger than those in the outer peripheral portion of the inductor substrate. Specifically, the coil portion cross-sectional area increases with decreasing distance to the center of the substrate, while the area where the magnetic fluxes interlink is not changed. That is, as illustrated in FIG. 9, a structure is employed in which the relationship w3>w2>w1 holds and the turn density (N/l) decreases toward the center. With this structure, it becomes possible to reduce the amount of heat generated at the central portion of the inductor substrate, where the temperature becomes relatively high, more so than at the outer peripheral portion. Thus, the amount of generated heat becomes uniform, and it becomes possible to prevent the inductor from generating localized heat. As a result, it is possible to decrease the maximum temperature of the inductor. In addition, it is also possible to utilize thermal diffusion effectively to cool the inductor. Thus, it is possible to decrease the macroscopic thermal resistance in the inductor. Here, "thermal diffusion" refers to the phenomenon of the movement of a substance in a temperature gradient. "Thermal resistance" is a value that represents the difficulty in transmitting heat, and refers to the amount of temperature rise per amount of generated heat per unit time.

In the fifth embodiment, the width w of the rectangular cross-sectional areas S1 of the coil portion 4D increases with decreasing distance to the center of the substrate 2 in the +X direction (w3>w2>w1). That is, due to the magnitude relationship of w3>w2>w1, the structure is such that the turn density (N/l) decreases toward the center of the substrate 2. Thus, it becomes possible to reduce the amount of heat generated at the central portion of the substrate 2, where the temperature becomes relatively high, more so than at the outer peripheral portion. The amount of heat generated in the power inductor 1E thereby becomes uniform. That is, it is possible to prevent the power inductor 1E from generating localized heat. As a result, it is possible to decrease the maximum temperature of the power inductor 1E. The other actions are the same as those in the first embodiment, so that the descriptions thereof are omitted.

The effects are described next. The effects listed below can be obtained for the power inductor 1E according to the fifth embodiment.

(13) The width (width w) of the rectangular cross-sectional areas (cross-sectional areas S1) of the coil portion (coil portion 4D) increases with decreasing distance to the center of the substrate (substrate 2) (FIG. 9). Thus, in addition to the effects of (1) to (12) above, it is possible to decrease the maximum temperature of the inductor (power inductor 1E).

The inductor of the present invention was described above based on the first to the fifth embodiments, but specific configurations thereof are not limited to these embodiments, and various modifications and additions to the design can be made without departing from the scope of the invention according to each claim in the Claims.

In the first to the fifth embodiments, examples were shown in which the coil portions are made of copper. In addition, in the third and fourth embodiments, examples were shown in which the outer layer coil portions are made of copper. However, the invention is not limited in this way. For example, the coil portions and the outer layer coil portions can be formed of metals such as silver, gold, or aluminum. In short, any metal with relatively high conductivity is suitable.

In the first to the fifth embodiments, examples were shown in which the base material is silicon. However, the invention is not limited thereto. For example, the base material can be ferrite, glass epoxy, or the like. In the case that the base material is ferrite, the portion that is filled with the magnetic material increases, which reduces the leakage magnetic flux, and high inductance can be obtained. In the case that the base material is glass epoxy, since the base material can be produced using the same device used for printed-circuit boards, the inductor can be manufactured at low cost.

In the first to the fifth embodiments, examples were shown in which the coil portion inter-turn gaps are filled and insulated with silicon oxide film. However, the invention is not limited in this way. For example, the coil portion inter-turn gaps can be insulated by being filled with silicon, which is the base material, and the silicon oxide film. In short, it suffices if the coil portion inter-turn gaps are filled with an insulating material.

In the first to the fifth embodiments, examples were shown in which the width w of the rectangular cross-sectional areas S1 of the coil portion is made larger than the thickness t of the rectangular cross-sectional areas S1 (w>t). However, the invention is not limited in this way. The width w of the rectangular cross-sectional areas S1 can be set to be at least the thickness t of the rectangular cross-sectional areas S1 (w≥2t). As a result, it is possible to increase the area that is surrounded by the coil portion while suppressing the electrical resistance, even when the arrangement space of the substrate 2 is limited. Although the turn density (MD is sacrificed by increasing w, an excessive increase in the turn density (N/l) causes magnetic saturation, and the magnetic flux density of the core reaches the saturation magnetic flux density. That is, the effect that it is possible to hold the magnetic flux density of the core to a desired value that it less than or equal to the saturation magnetic flux density even if the turn density (N/l) is sacrificed can be obtained.

In the second embodiment, an example was shown in which the gap G is filled with a non-magnetic material, such as air. However, the invention is not limited in this way. For example, the gap G can be filled with a member having a relative permeability of 10 or less. In short, it suffices if the gap G is filled with a member that has a relatively low permeability.

In the second embodiment, an example was shown in which the permeability inside of each of the coil portions 4A-4H is reduced in the innermost portion than at the end portion 4*e*, to adjust the permeability of the entire magnetic path. However, the invention is not limited in this way. For example, the permeability of the entire magnetic path can be adjusted by placing a ferrite core in which particles of a magnetic material are sintered via an insulating layer, in a portion of the insides of the coil portions 4A-4H excluding the end portions 4*e*, within a range in which magnetic saturation is not reached. In short, it suffices if a core with a relative permeability of 100 or more is placed in a portion of the insides of the coil portions 4A-4H, excluding the end portions 4*e*. The base material at this time can be a printed-circuit board material, such as an S1 substrate or FR4. In addition, a ferrite-based magnetic material substrate, etc., can be used by using a processing method that retains the core portion. Here, "FR (Flame Retardant Type) 4" (refer to FIG. 3) refers to a material obtained by impregnating a glass fiber cloth with epoxy resin and applying a heat curing treatment thereto to form a plate.

In the second embodiment, an example was shown in which the conductor 13 is formed on the upper surface 80Tu and the upper surface 2U of the substrate 2, by means of the CVD method (refer to FIG. 7G). In addition, in the second embodiment, an example was shown in which the conductor 14 is formed on the lower surface 80Td and the lower surface 2D of the substrate 2 by means of the CVD method (refer to FIG. 7*p*). However, the invention is not limited in this way. For example, well-known methods such as a sputtering method and a vacuum evaporation method can be used as the film-forming method.

In the second embodiment, an example was shown in which the main directions of the magnetic fluxes that are generated in accordance with the electric current (+X direction, −X direction) are different in the plurality of coil portions (coil portions 4A-4H). However, the invention is not limited in this way. For example, the axes of the plurality of coil portion (coil portions 4A-4H) can be different. That is, the magnetic fluxes that are generated along the axes can be coupled in series between the coil portions 4A-4H. Thus, the number of turns (N) of the magnetically coupled coil portions 4A-4H, which are connected in series, increases. As a result, it is possible to improve the inductance without increasing the magnetic flux density. Therefore, the same effects as (6) above can be achieved.

In the first to the fifth embodiments, examples were shown in which the inductor of the present invention is applied to an inverter that is used as an AC/DC conversion device of a motor/generator. However, the inductor of the present invention can be applied to various power conversion devices other than an inverter.

The invention claimed is:

1. An inductor using a substrate as a base material, the inductor comprising:

a core portion;

a coil portion;

an insulating portion formed between conductors of the coil portion; and a terminal portion connecting the core portion and the coil portion to outside of the inductor;

a main direction of a magnetic field being generated in accordance with a current flowing through the coil portion extends in a planar direction of the substrate, and in at least a portion of the coil portion, both a width and a thickness of a rectangular cross-sectional area of the coil portion are larger than a width of the insulating portion, the main direction of the planar direction being a direction of the width of the rectangular cross-sectional area of the coil portion and the width of the insulating portion.

2. The inductor according to claim 1, wherein both the width and the thickness of the rectangular cross-sectional area of the coil portion are larger than the width of the insulating portion in all regions of the coil portion.

3. The inductor according to claim 1, wherein the width of the rectangular cross-sectional area of the coil portion is larger than the thickness of the rectangular cross-sectional area of the coil portion.

4. The inductor according to claim 1, wherein a plurality of the coil portions are provided, the plurality of the coil portions are formed side by side in a planar direction of the substrate, and a magnetic flux is generated in accordance with the current flowing through the plurality of the coil portions are coupled in series inside of the plurality of coil portions.

5. The inductor according to claim 1, wherein a plurality of the coil portions are provided having different main directions, and a magnetic flux is generated in accordance with the current flowing through the plurality of the coil portions that are coupled in series between the plurality of the coil portions.

6. The inductor according to claim 1, further comprising at least one outer layer coil portion disposed on an outer layer of the coil portion via the insulating portion, and the main direction of the magnetic field that is generated in accordance with the current that flows in the outer layer coil portion is the same as the main direction of the magnetic field that is generated in accordance with the current that flows in the coil portion.

7. The inductor according to claim 6, wherein the outer layer coil portion has conductors disposed on the outer layer of the insulating portion that is formed between the conductors of the coil portion.

8. The inductor according to claim 6, wherein the number of the conductors of the outer layer coil portion is less than the number of conductors of the coil portion.

9. The inductor according to claim 6, wherein the outer layer coil portion is connected in series with the coil portion.

10. The inductor according to claim 6, wherein a plurality of the coil portions are connected together in series, a plurality of the outer layer coil portions are connected together in series, and the plurality of the coil portions connected together in series and the plurality of the outer layer coil portions connected together in series are connected in parallel.

11. The inductor according to claim 5, wherein the core portion is disposed between at least one of the coil portions.

12. The inductor according to claim 1, wherein the width of the rectangular cross-sectional area of the coil portion increases with decreasing distance to a center of the substrate.

13. The inductor according to claim 1, wherein the base material is any one of silicon, ferrite, or glass epoxy.

* * * * *